US010703116B2

(12) United States Patent
Otsuka et al.

(10) Patent No.: US 10,703,116 B2
(45) Date of Patent: Jul. 7, 2020

(54) RECORDING APPARATUS

(71) Applicant: SEIKO EPSON CORPORATION, Tokyo (JP)

(72) Inventors: Kazuo Otsuka, Azumino (JP); Satoshi Nakata, Matsumoto (JP); Katsumi Yamada, Matsumoto (JP); Manato Nishi, Shiojiri (JP); Kenichi Furuya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/046,879

(22) Filed: Jul. 26, 2018

(65) Prior Publication Data

US 2019/0030931 A1 Jan. 31, 2019

(30) Foreign Application Priority Data

Jul. 28, 2017 (JP) ..... 2017-146668
Jan. 18, 2018 (JP) ..... 2018-006552

(51) Int. Cl.

| | |
|---|---|
| ***B65H 1/26*** | (2006.01) |
| ***B41J 15/04*** | (2006.01) |
| ***B65H 1/04*** | (2006.01) |
| ***B41J 13/10*** | (2006.01) |

(52) U.S. Cl.

CPC ..... *B41J 15/044* (2013.01); *B41J 13/103* (2013.01); *B41J 13/106* (2013.01); *B65H 1/04* (2013.01); *B65H 1/266* (2013.01); *B65H 2405/115* (2013.01); *B65H 2405/1122* (2013.01); *B65H 2405/11164* (2013.01); *B65H 2405/31* (2013.01)

(58) Field of Classification Search

CPC .... B65H 1/266; B65H 1/04; B65H 2405/115; B65H 2405/1164; B65H 2405/1122; B65H 2405/31; B41J 15/044; B41J 13/106; B41J 13/103

See application file for complete search history.

(56) References Cited

U.S. PATENT DOCUMENTS

| | | | | |
|---|---|---|---|---|
| 2008/0179820 | A1 | 7/2008 | Kawamura et al. | |
| 2010/0124449 | A1* | 5/2010 | Asada | B65H 1/04 399/393 |
| 2014/0319761 | A1* | 10/2014 | Komuro | B65H 31/20 271/223 |

FOREIGN PATENT DOCUMENTS

| | | |
|---|---|---|
| JP | 2008-184297 A | 8/2008 |
| JP | 2017-077932 A | 4/2017 |

* cited by examiner

*Primary Examiner* — Sharon A. Polk
(74) *Attorney, Agent, or Firm* — Workman Nydegger

(57) ABSTRACT

A recording apparatus includes a medium storage cassette which includes a medium storage region and is capable of being inserted and removed with respect to an apparatus main body, in which the medium storage cassette includes a main cassette unit and a sub-cassette unit which is capable of switching between a first state and a second state which is displaced more in the removal direction than in the first state to expand the medium storage region, and in which the apparatus main body includes a cover which is provided to be capable of being displaced between a position corresponding to the first state of the sub-cassette unit and a position corresponding to the second state and which covers a top portion of the medium storage region on the removal direction side.

5 Claims, 24 Drawing Sheets

RECORDING APPARATUS

BACKGROUND

1. Technical Field

The present invention relates to a recording apparatus which is provided with a medium storage cassette which stores a medium.

2. Related Art

In the related art, there is wide use of a paper feeding cassette which is attachable and detachable with respect to an apparatus main body in a recording apparatus which is represented by a printer or a copier. As illustrated in JP-A-2008-184297, the paper feeding cassette includes one which is configured by a main body and a drawer portion and which is configured such that the drawer portion is pulled out to increase the length of the paper feeding cassette and becomes capable of storing sheets of a large size in comparison to the size of sheets that can be stored before pulling out the drawer portion.

When a cover is provided on the main body of the paper feeding cassette described in JP-A-2008-184297, in a case in which the drawer portion is pulled out, there is a concern that a range which may not be covered by the cover will be formed widely on the pulled-out side. When a cover is provided on the drawer portion, in a case in which the drawer portion is pulled out, there is a concern that a range which may not be covered by the cover will be formed widely on the main body side.

Additionally, when a configuration is adopted in which a user adjusts the position of the cover every time the position of the drawer portion is switched, manipulation by the user becomes troublesome, which is unfavorable.

When a cover which covers the top portion of the paper feeding cassette is provided, there is an associated increase in cost.

SUMMARY

An advantage of some aspects of the invention is to more suitably cover a top portion of a cassette in a configuration in which it is possible to switch the length of a cassette. Another advantage of some aspects of the invention is to improve usability in a configuration in which a cover which covers a top portion of a cassette is provided. Still another advantage of some aspects of the invention is to obtain a configuration which covers a paper feeding cassette while suppressing an increase in cost.

According to an aspect of the invention, there is provided a recording apparatus which includes a recording unit which performs recording on a medium, and a medium storage cassette which includes a medium storage region which stores the medium, is attachable and detachable with respect to an apparatus main body which is provided with the recording unit, and is configured such that the medium storage region is capable of expanding and contracting along an attachment-detachment direction, in which the medium storage cassette includes a main cassette unit which forms a portion of the medium storage region, and a sub-cassette unit which is positioned in a removal direction from the apparatus main body of the medium storage cassette with respect to the main cassette unit, forms a portion of the medium storage region, and is capable of switching between a first state and a second state which is displaced more in the removal direction than in the first state to expand the medium storage region, and in which the apparatus main body includes a cover which is provided to be capable of being displaced between a first cover position corresponding to the first state of the sub-cassette unit and a second cover position corresponding to the second state and which covers a portion of a top portion of the removal direction side of the medium storage region.

In this configuration, since the apparatus main body of the recording apparatus is provided with the cover which is provided to be capable of being displaced between the first cover position corresponding to the first state of the sub-cassette unit and the second cover position corresponding to the second state and which covers a portion of a top portion of the removal direction side of the medium storage region, whether the state of the sub-cassette unit is the first state or the second state, it is possible to suitably cover the top portion of the removal direction side of the medium storage region.

In the recording apparatus, the cover may receive a motive force of a motor and be displaced.

In this configuration, since the cover obtains the motive force of the motor and is displaced, it is possible to cover the top portion of the apparatus front side of the medium storage region without the user manipulating the cover, and the usability of the medium storage cassette is improved.

In the recording apparatus, the cover may overlap a portion of the medium storage cassette in an apparatus height direction.

In this configuration, since the cover overlaps a portion of the medium storage cassette in the apparatus height direction, it is possible to suppress the apparatus dimensions in the apparatus height direction.

The recording apparatus may further include a pushing member which pushes the cover toward the second cover position, in which the cover may be displaced in accordance with state switching of the sub-cassette unit due to a pushing force of the pushing member.

In this configuration, since the recording apparatus further includes the pushing member which pushes the cover toward the second cover position and the cover is displaced in accordance with state switching of the sub-cassette unit due to a pushing force of the pushing member, it becomes unnecessary to manipulate the cover and the usability of the medium storage cassette is improved.

In the recording apparatus, the cover may include a grip recessed portion on a free end of the removal direction side, when the medium storage cassette is completely installed in the apparatus main body and the sub-cassette unit assumes the first state, the medium storage cassette may assume a non-protruding state from a side surface of a front side of the apparatus main body, and when the medium storage cassette is completely installed in the apparatus main body and the sub-cassette unit assumes the second state, the medium storage cassette may protrude from the side surface of the front side of the apparatus main body and the grip recessed portion may be exposed.

In this configuration, when the medium storage cassette is completely installed in the apparatus main body and the sub-cassette unit assumes the second state, since the medium storage cassette protrudes from the side surface of the front side of the apparatus main body and the grip recessed portion is exposed, it is possible to store the medium by manipulating the cover without removing the medium storage cassette from the apparatus main body when the sub-cassette unit is in the second state.

According to another aspect of the invention, there is provided a recording apparatus which includes a recording unit which performs recording on a medium, and a medium storage cassette which includes a medium storage region which stores the medium and is attachable and detachable with respect to an apparatus main body which is provided with the recording unit, in which the medium storage cassette includes a cover which covers a top portion of a portion of the medium storage region, and in which the cover includes a rear end edge guide which restricts a position of a rear end edge which is an edge on the removal direction side of the medium which is stored in the medium storage region and the cover is provided to be capable of sliding in the attachment-detachment direction.

In this configuration, since the cover which covers a top portion of a portion of the medium storage region includes the rear end edge guide which restricts the position of the rear end edge which is an edge of the medium on the removal direction side and the cover is provided to be capable of sliding in the attachment and detachment direction, when the rear end edge guide is aligned to the position of the rear end edge of the medium, the cover covers the top portion region, it is possible to favorably suppress adherence of dust or the like to the top portion of the stored medium, and the usability of the medium storage cassette is improved.

In the recording apparatus, a bottom end portion of the rear end edge guide may be at a height less than or equal to that of a medium placement surface on which the medium is placed in the medium storage region.

In this configuration, since the bottom end portion of the rear end edge guide is at a height less than or equal to that of the medium placement surface on which the medium is placed in the medium storage region, it is possible to suitably restrict the rear end edge position of all of the media which are stacked (in particular, the bottommost medium).

In the recording apparatus, the cover may be provided to be capable of rotating using an apparatus rear side of the cover as a fulcrum and opens and closes a portion of the medium storage region by rotating.

In this configuration, since the cover is provided to be capable of rotating using an apparatus rear side of the cover as a fulcrum and opens and closes a portion of the medium storage region by rotating, it becomes easy to refill the medium storage region with the medium.

In the recording apparatus, the cover may be provided to be capable of rotating using an apparatus front side of the cover as a fulcrum and opens and closes a portion of the medium storage region by rotating.

In this configuration, since the cover is provided to be capable of rotating using an apparatus front side of the cover as a fulcrum and opens and closes a portion of the medium storage region by rotating, in a case in which the medium is stored on the apparatus rear side of the medium storage region (for example, a case in which a medium of a small size is stored), the working properties are improved.

In the recording apparatus, the cover may be displaced along a guide groove which is formed in a side wall which is provided to extend along a displacement direction of the cover.

In this case, since the cover is displaced along a guide groove which is formed in a side wall which is provided to extend along a displacement direction of the cover, it is possible to stably displace the cover.

According to still another aspect of the invention, there is provided a recording apparatus which includes a recording unit which performs recording on a medium, and a medium storage cassette which includes a medium storage region which stores the medium, is attachable and detachable with respect to an apparatus main body which is provided with the recording unit, and is configured such that the medium storage region is capable of expanding and contracting along an attachment-detachment direction, in which the medium storage cassette includes a main cassette unit which forms a portion of the medium storage region, a sub-cassette unit which is positioned in a removal direction from the apparatus main body of the medium storage cassette with respect to the main cassette unit, forms a portion of the medium storage region, and is capable of switching between a first state and a second state which is displaced more in the removal direction than in the first state to expand the medium storage region, and a cover which covers a top portion of the medium storage region on the removal direction side and is provided on the sub-cassette unit, in which, by rotating, the cover switches between a first posture in which the cover is prone along a wall on the removal direction side of the sub-cassette unit and a second posture in which the cover covers a top portion on the removal direction side in the medium storage region by being stood up from the first posture, and in which an engagement protrusion which engages with the cover is provided on the main cassette unit and by switching the sub-cassette unit from the first state to the second state, the engagement protrusion switches the cover from the first posture to the second posture.

In this configuration, since the engagement protrusions switch the cover from the first posture to the second posture by switching the sub-cassette unit from the first state to the second state, it is not necessary to manipulate the cover itself and the usability of the medium storage cassette is improved.

According to still another aspect of the invention, there is provided a recording apparatus which includes a recording unit which performs recording on a medium, a feed tray which is provided in an apparatus main body which includes the recording unit, includes a placement surface on which the medium which is fed is placed, and is capable of switching between a storage state which is a non-extended state of the placement surface and an extended state in which the placement surface is extended to an outside of the apparatus main body and in which it is possible to place the medium on the placement surface, and a medium receiving tray which includes a medium receiving surface which receives the medium which is subjected to recording by the recording unit and is discharged, and is capable of switching between a first state which is a non-extended state of the medium receiving surface and a second state in which the medium receiving surface is extended to the outside of the apparatus main body, in which the medium receiving tray assumes a state of covering the medium which is placed on the feed tray between the first state and the second state.

In this configuration, since the medium receiving tray which receives the medium which is subjected to recording and is discharged covers the medium which is placed on the feed tray, it is not necessary to provide a dedicated cover which covers the feed tray and it is possible to suppress an increase in the cost of the apparatus.

In the recording apparatus, the medium which is placed on the feed tray may be visually recognizable from a side in a medium width direction which is a direction intersecting a medium feed direction in a state in which the medium receiving tray covers the medium which is placed on the feed tray.

In this configuration, since the medium which is placed on the feed tray is visually recognizable from a side in a medium width direction which is a direction intersecting a medium feed direction in a state in which the medium receiving tray covers the medium which is placed on the feed tray, it is possible to easily recognize the remaining number of sheets of the media which are placed on the feed tray.

In the recording apparatus, the medium receiving tray may include a base tray which is positioned closest to the apparatus main body side in the second state, and at least one sub-tray which is positioned on a side which is further from the apparatus main body than the base tray, the base tray and the sub-tray may be stored in an inner portion of the apparatus main body in the first state, and by pulling out the base tray from the apparatus main body, the base tray may cover the medium which is placed on the feed tray.

In this configuration, since it is possible to cover the medium which is placed on the feed tray using the base tray which is positioned closest to the apparatus main body side in the second state of the medium receiving tray, it is possible to reliably cover the medium which is placed on the feed tray.

In the recording apparatus, the feed tray may be configured to switch between the storage state and the extended state by rotationally moving, the feed tray may block a progression path from the apparatus main body and a discharge port of the medium of the base tray and the sub-tray when the feed tray is in the storage state, and by switching the feed tray from the storage state to the extended state, the feed tray may open the progression path.

In this configuration, since the feed tray blocks the progression path from the apparatus main body and the discharge port of the medium of the base tray and the sub-tray when the feed tray is in the storage state, it is possible to suppress the entrance or dust or the like into the inner portion of the apparatus.

In the recording apparatus, in the feed tray, a surface of an opposite side from the placement surface may form the same surface as an apparatus front surface when the feed tray is in the storage state.

In this configuration, in the feed tray, a surface of an opposite side from the placement surface is the same surface as an apparatus front surface when the feed tray is in the storage state, it is possible to reliably cover the medium which is placed on the feed tray.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
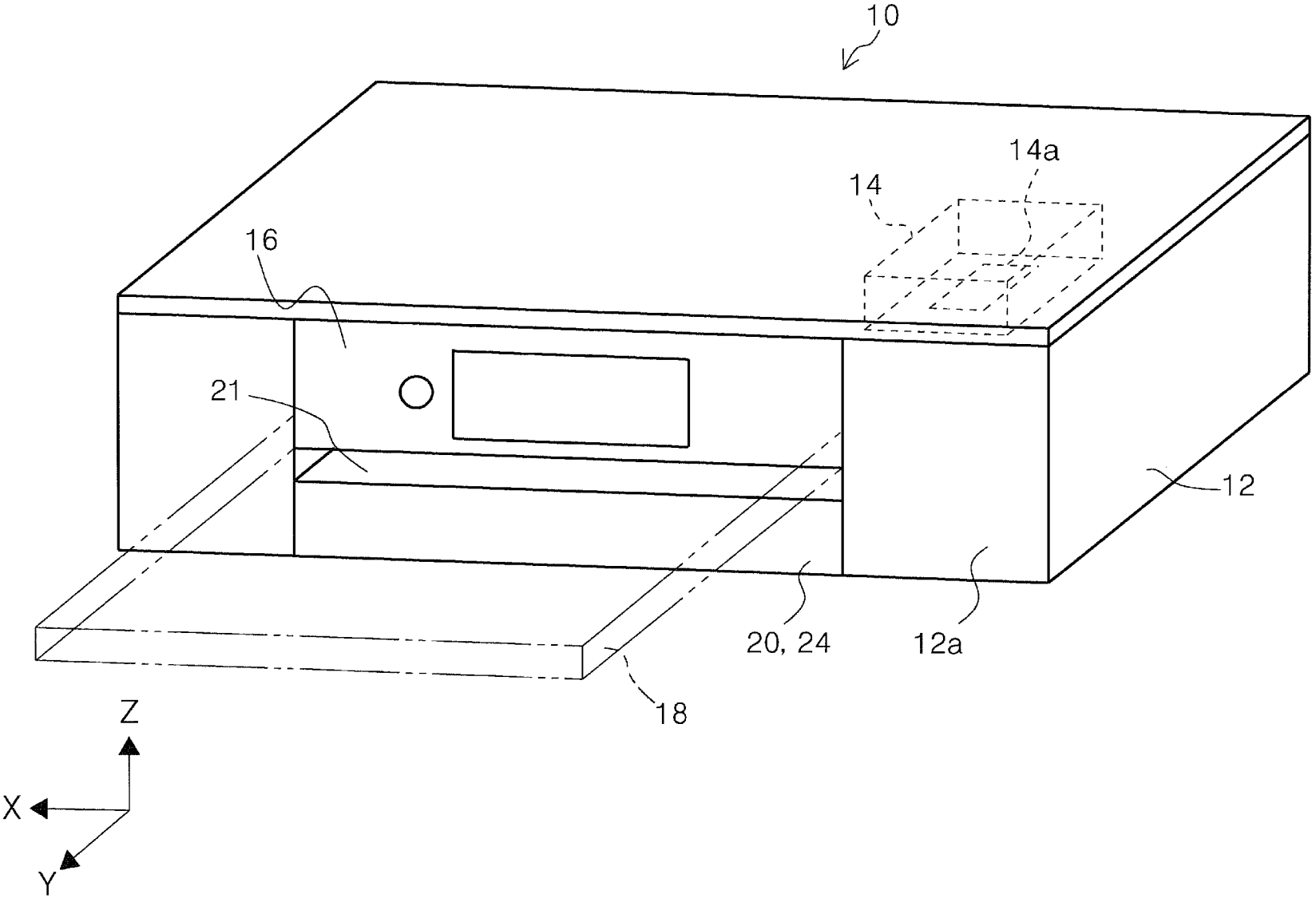
FIG. 1 is an external perspective view of a printer according to the invention.

Hereinafter, a description will be given of an embodiment of the invention with reference to the drawings. Regarding configurations which are the same in the embodiments, the same reference numerals will be given, a description will be given only in the first embodiment, and the description of the configurations will be omitted in the following embodiments.

Figure 2:
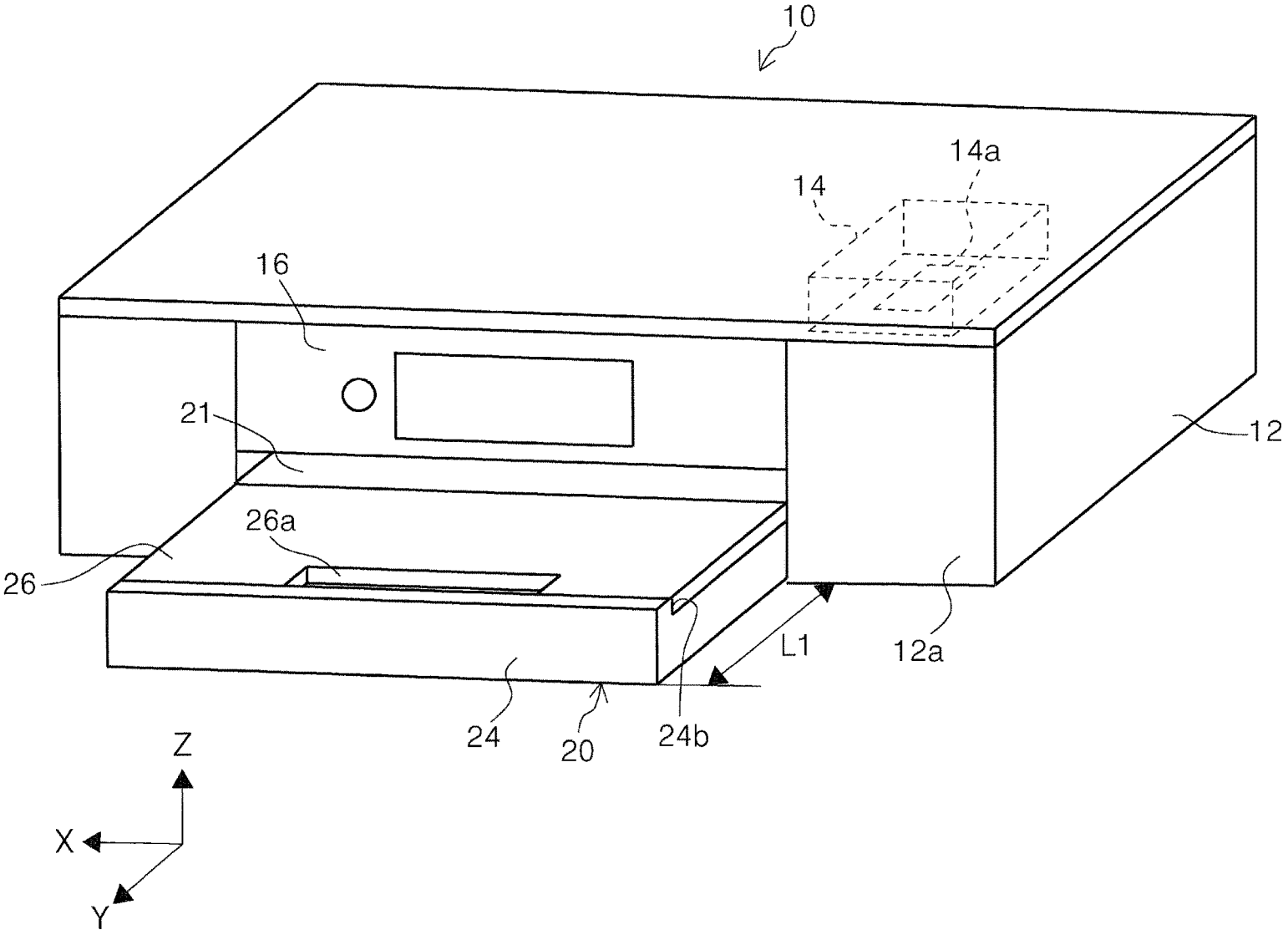
FIG. 2 is an external perspective view of the printer in a state in which a sub-cassette unit assumes a second state.
Figure 3:
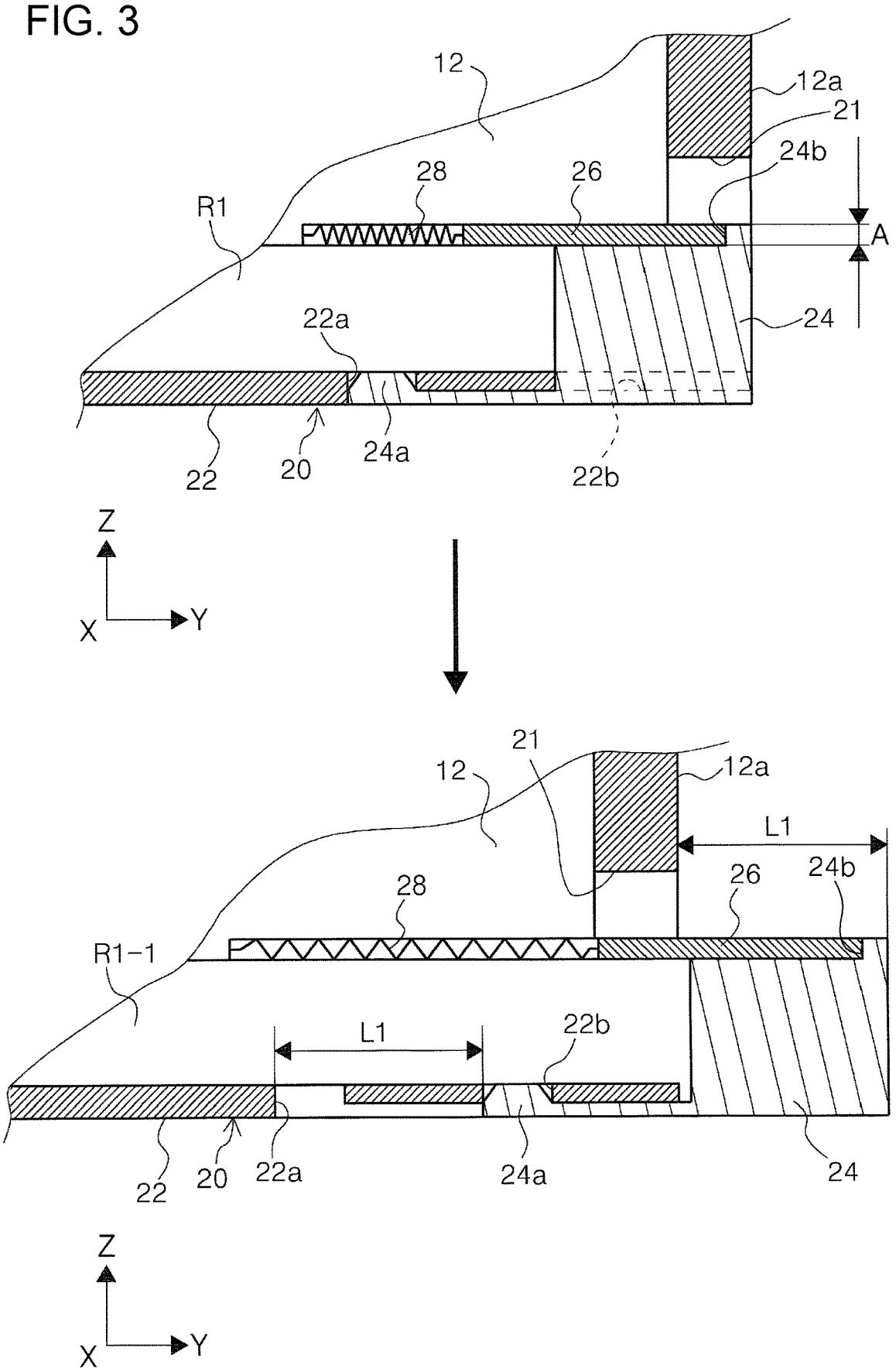
FIG. 3 is a schematic diagram illustrating the switching between a first state and a second state of the sub-cassette unit and the switching between a first cover position and a second cover position of a cover.
Figure 4:
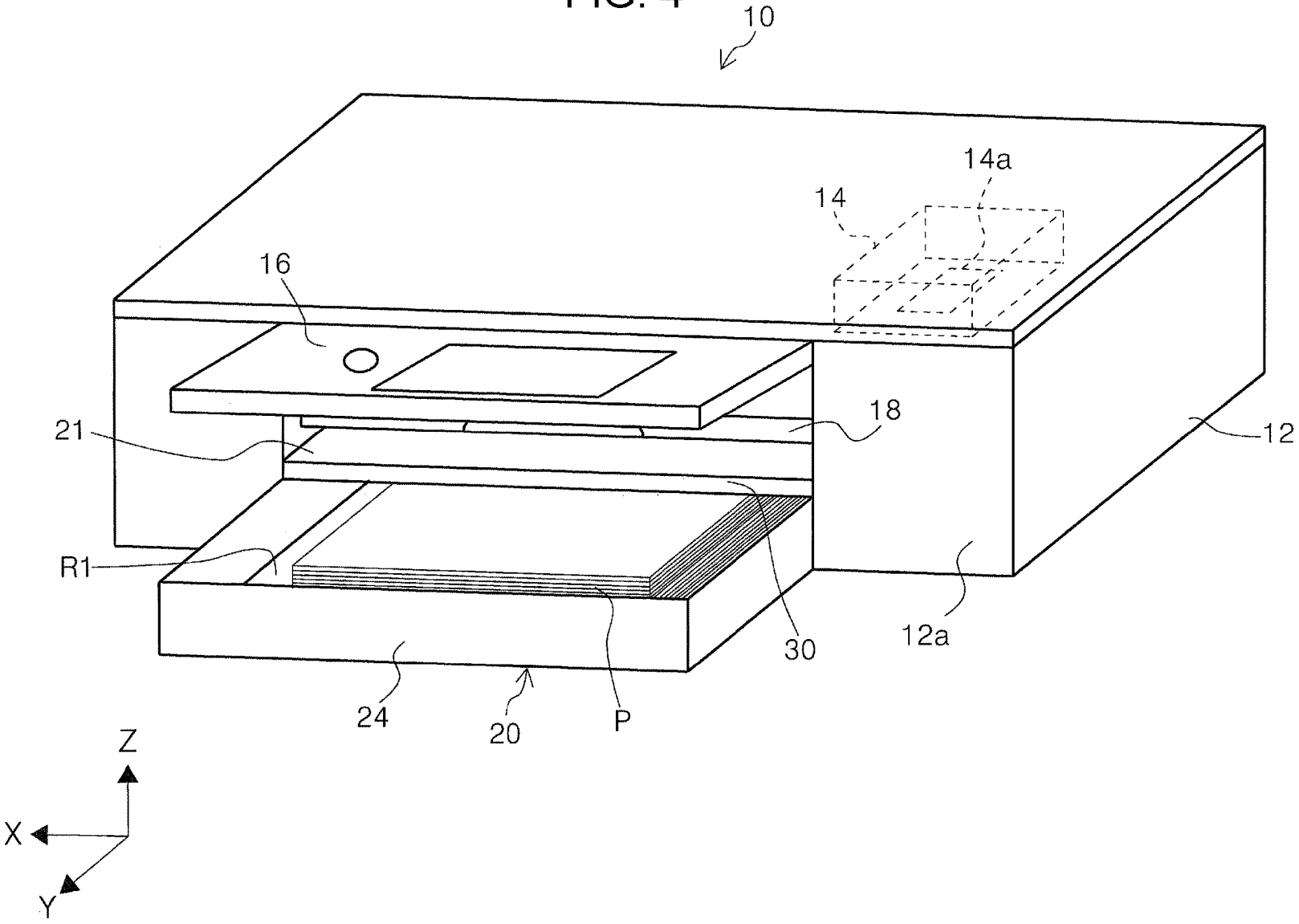
FIG. 4 is a perspective view illustrating a state in which a cover is positioned at a first cover position in a modification example of a first embodiment.

FIG. 1 is an external perspective view of a printer according to the invention, FIG. 2 is an external perspective view of the printer in a state in which a sub-cassette unit assumes a second state, FIG. 3 is a schematic diagram illustrating the switching between a first state and a second state of the sub-cassette unit and the switching between a first cover position and a second cover position of a cover, and FIG. 4 is a perspective view illustrating a state in which a cover is positioned at a first cover position in a modification example of a first embodiment.

Figure 5:
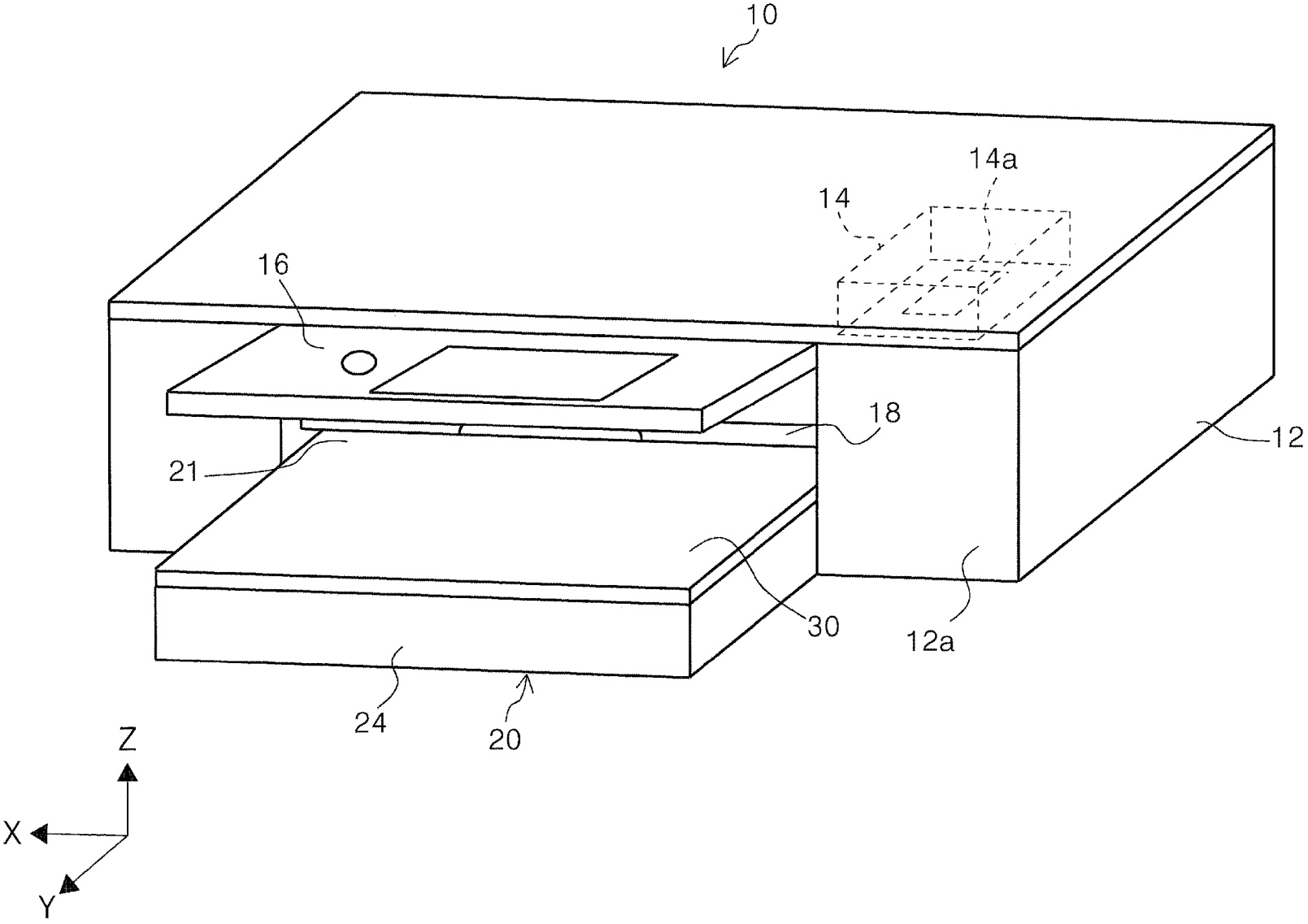
FIG. 5 is a perspective view illustrating a state in which a cover is positioned at a second cover position in the modification example of the first embodiment.
Figure 6:
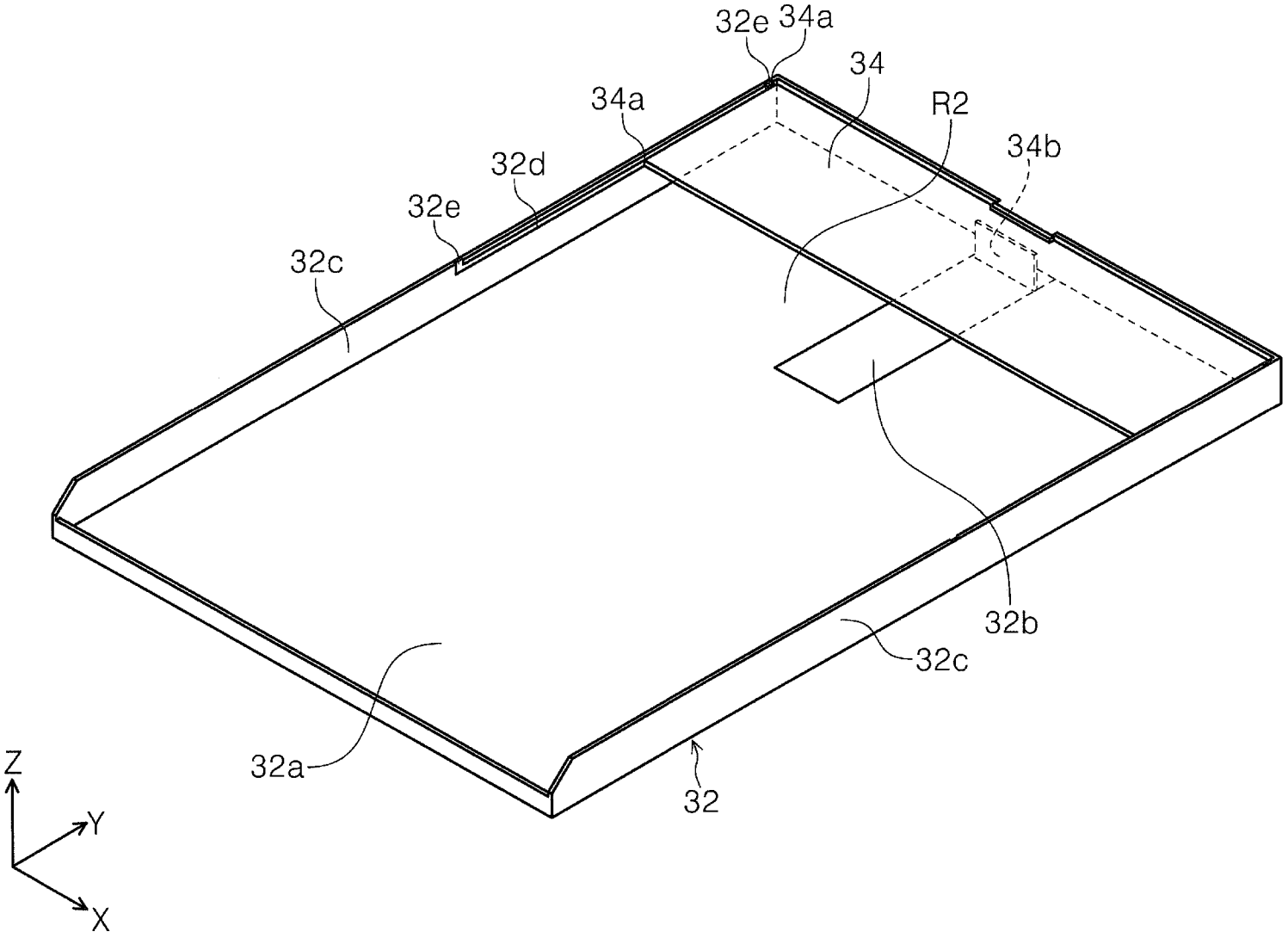
FIG. 6 is a perspective view of a medium storage cassette and a cover according to a second embodiment.
Figure 7:
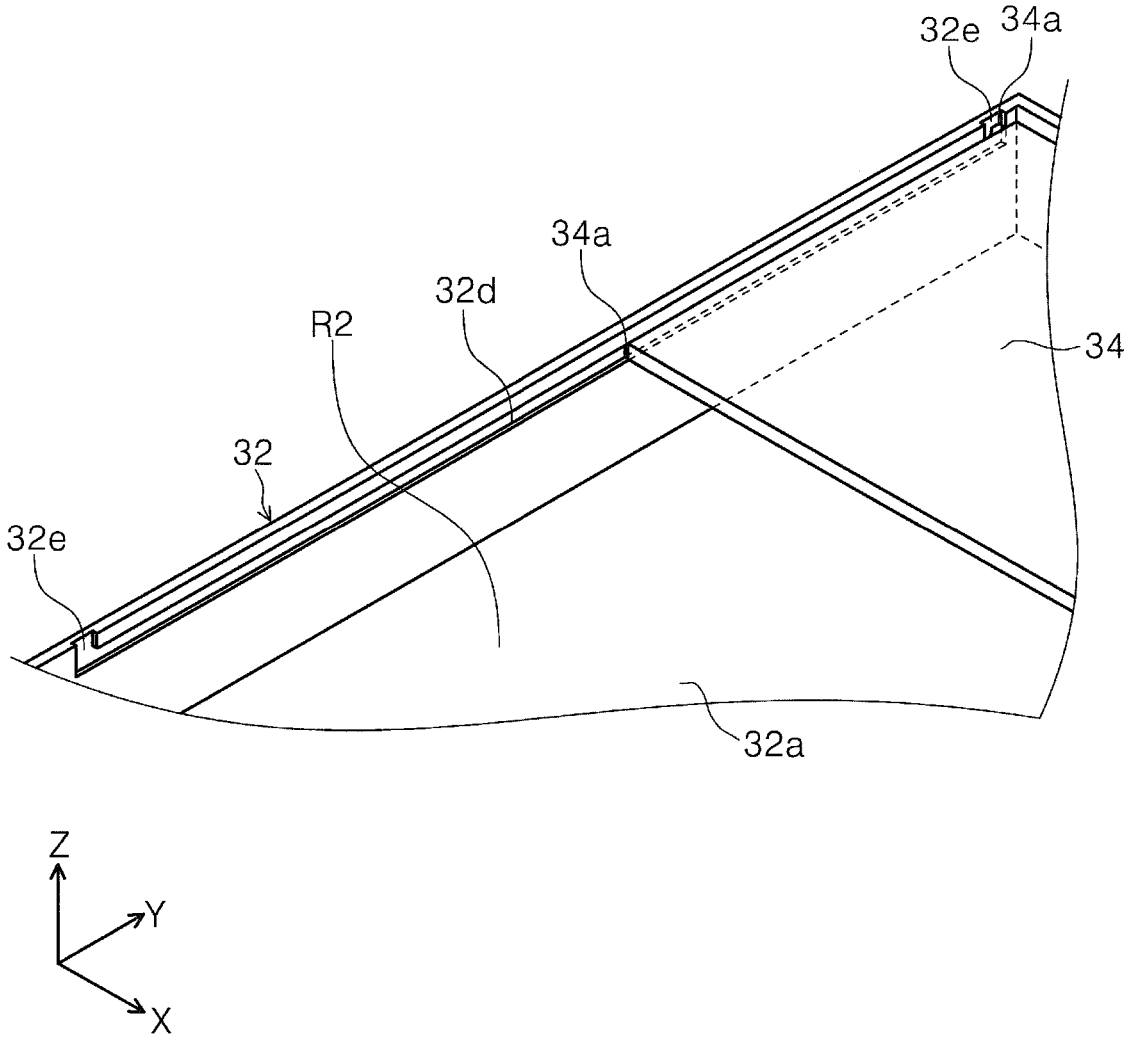
FIG. 7 is a perspective view illustrating a relationship between a guide groove and the cover which are provided in the medium storage cassette.
Figure 8:
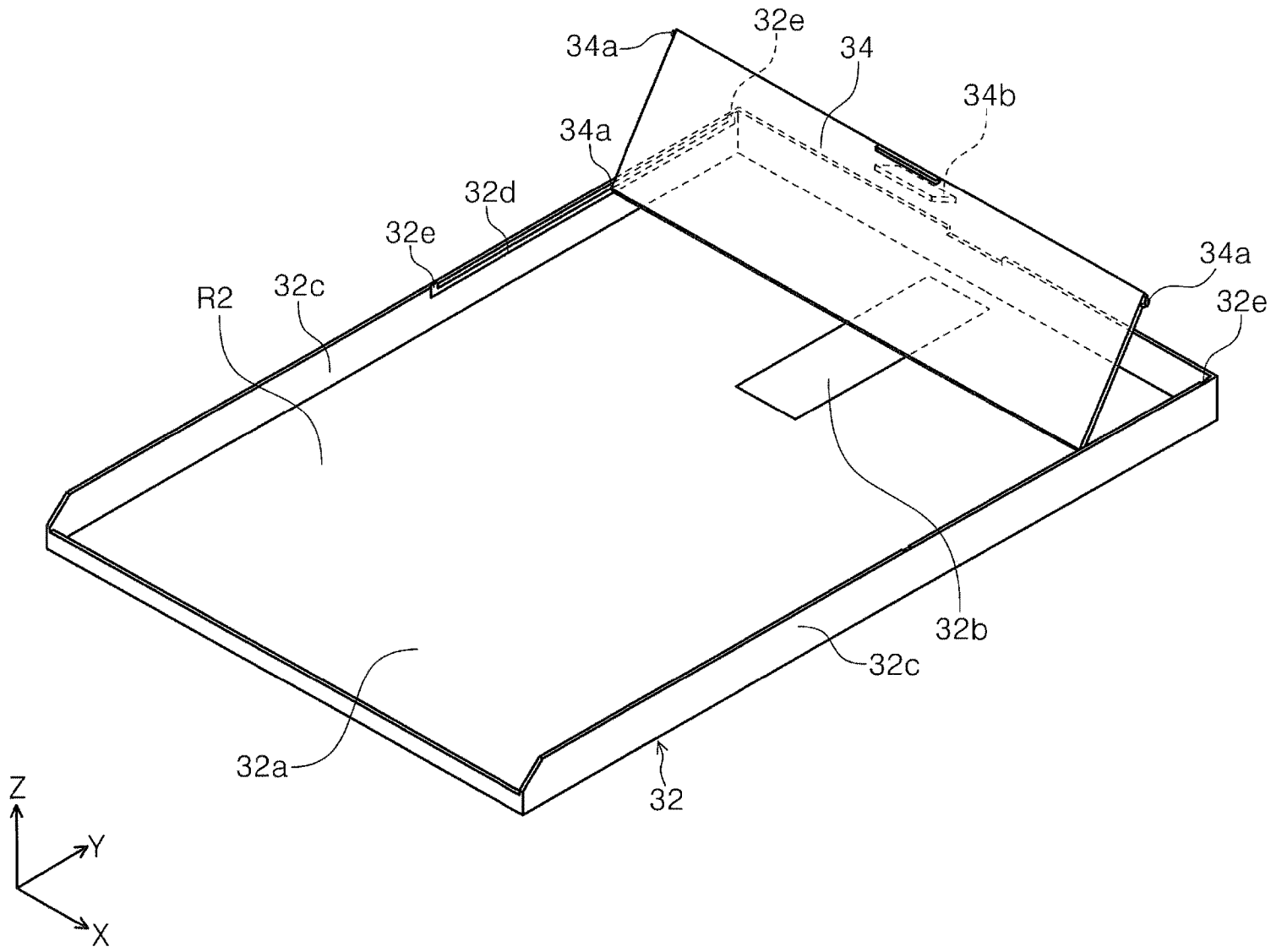
FIG. 8 is a perspective view illustrating a state in which the cover is rotationally moved at the front side of the medium storage cassette in an apparatus depth direction.

FIG. 5 is a perspective view illustrating a state in which a cover is positioned at a second cover position in the modification example of the first embodiment, FIG. 6 is a perspective view of a medium storage cassette and a cover according to a second embodiment, FIG. 7 is a perspective view illustrating a relationship between a guide groove and the cover which are provided in the medium storage cassette, and FIG. 8 is a perspective view illustrating a state in which the cover is rotationally moved at the front side of the medium storage cassette in an apparatus depth direction.

Figure 9:
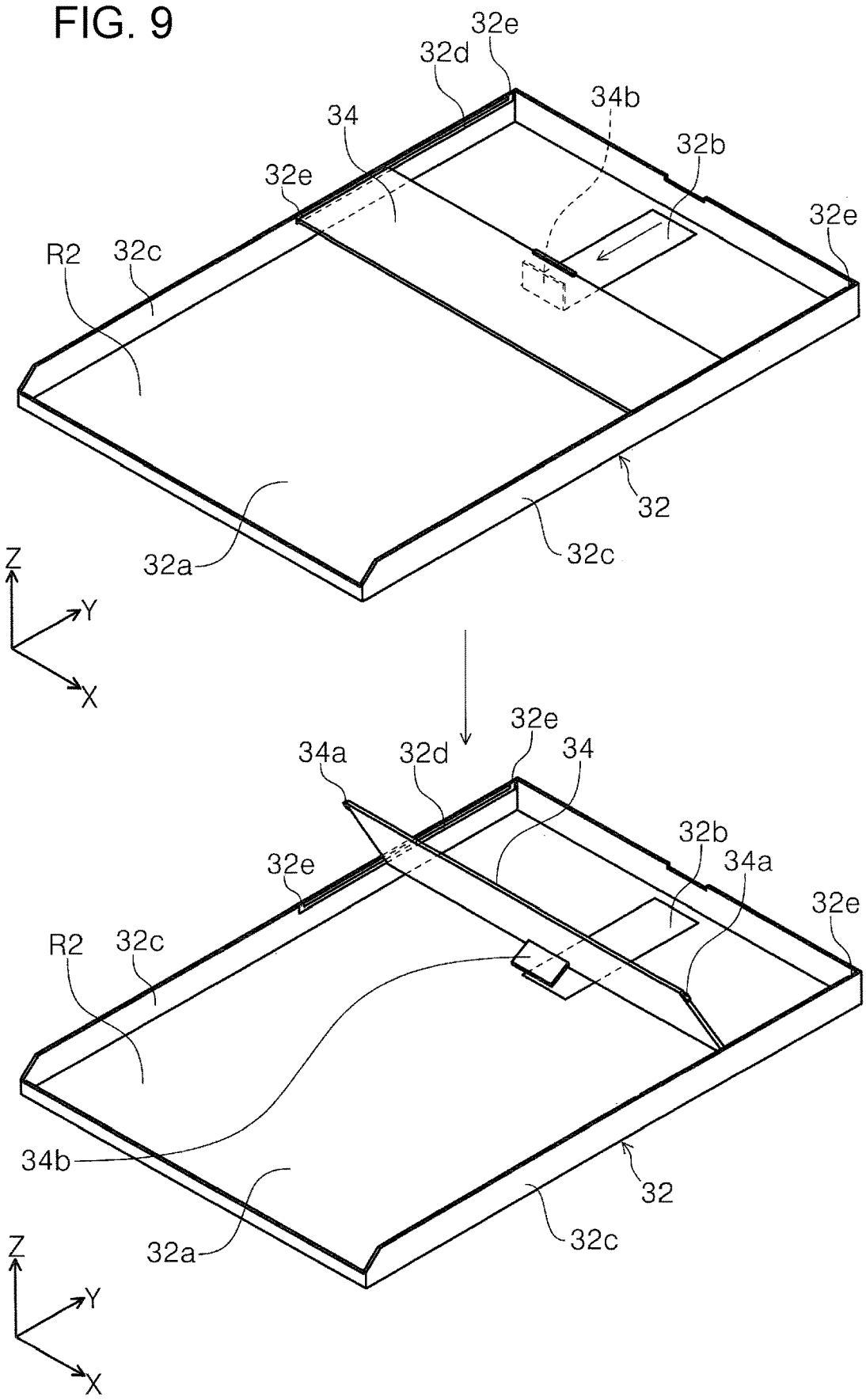
FIG. 9 is a perspective view illustrating a state in which the cover is moved in the apparatus depth direction with respect to the medium storage cassette and a state in which the cover is rotationally moved at the back side of the medium storage cassette in the apparatus depth direction.
Figure 10:
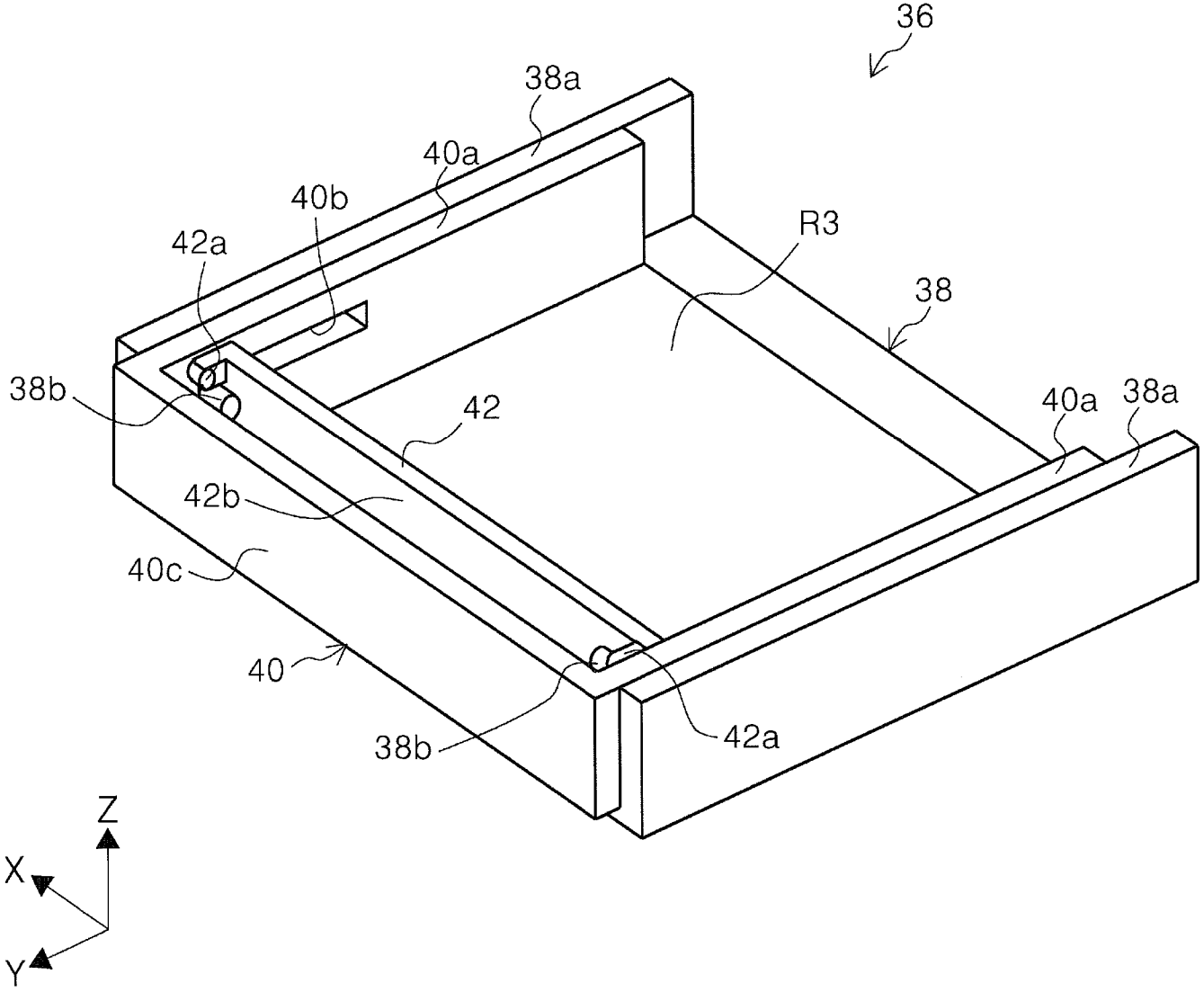
FIG. 10 is a perspective view illustrating a first state of a sub-cassette unit in a medium storage cassette according to a third embodiment.
Figure 11:
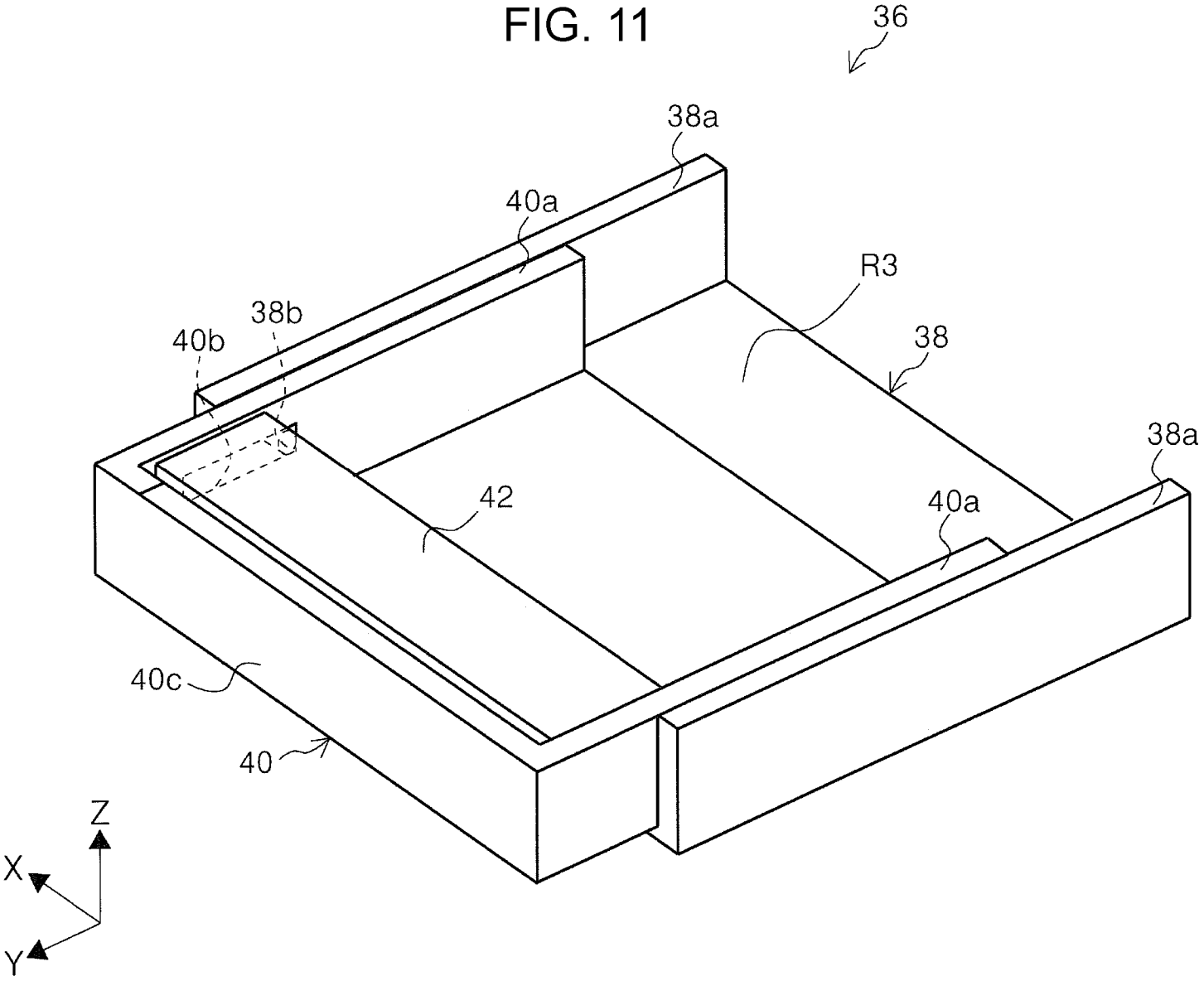
FIG. 11 is a perspective view illustrating a second state of the sub-cassette unit in the medium storage cassette according to the third embodiment.
Figure 12:
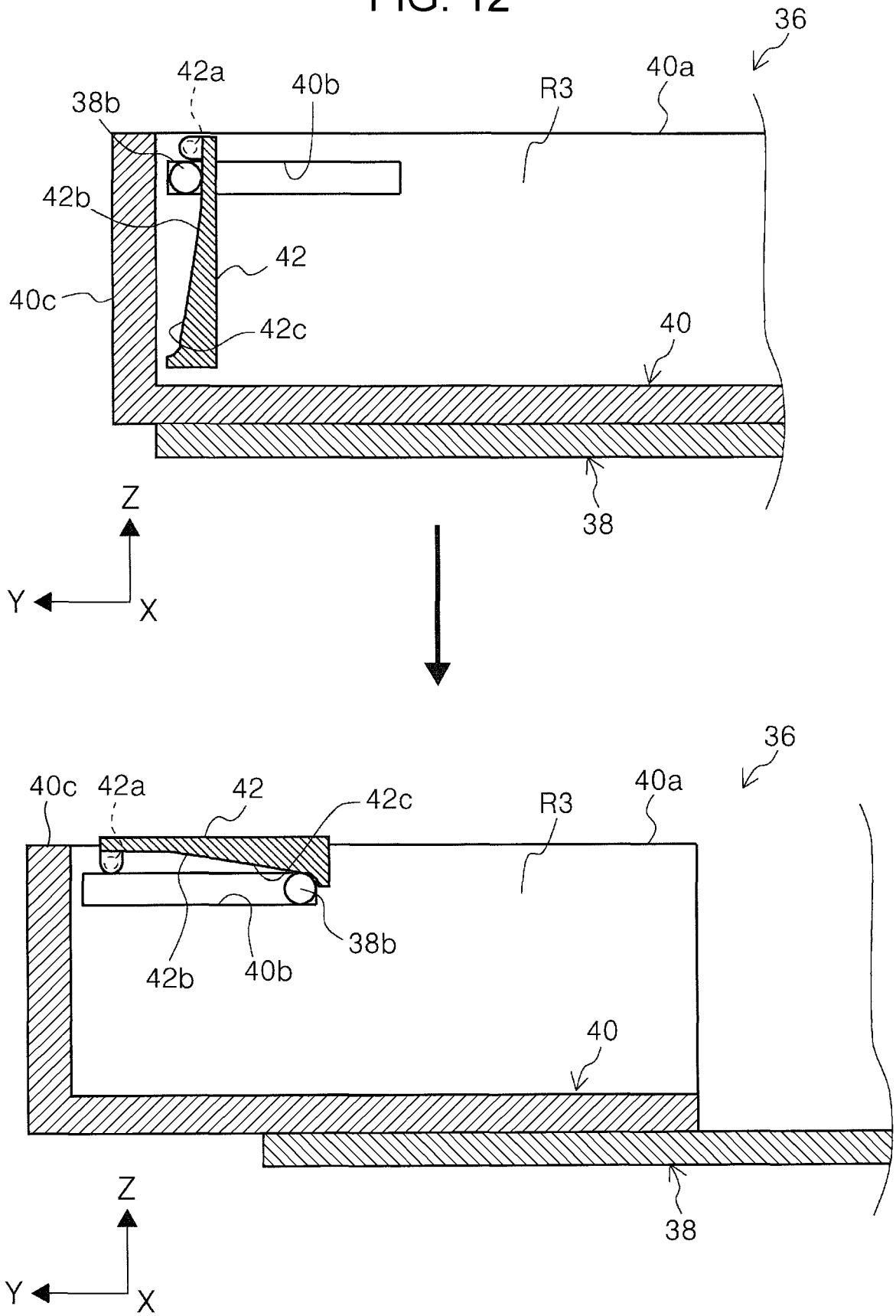
FIG. 12 is a schematic diagram illustrating the switching between a first posture and a second posture of a cover according to the third embodiment.

FIG. 9 is a perspective view illustrating a state in which the cover is moved in the apparatus depth direction with respect to the medium storage cassette and a state in which the cover is rotationally moved at the back side of the medium storage cassette in the apparatus depth direction, FIG. 10 is a perspective view illustrating a first state of a sub-cassette unit in a medium storage cassette according to a third embodiment, FIG. 11 is a perspective view illustrating a second state of the sub-cassette unit in the medium storage cassette according to the third embodiment, and FIG. 12 is a schematic diagram illustrating the switching between a first posture and a second posture of a cover according to the third embodiment.

Figure 13:
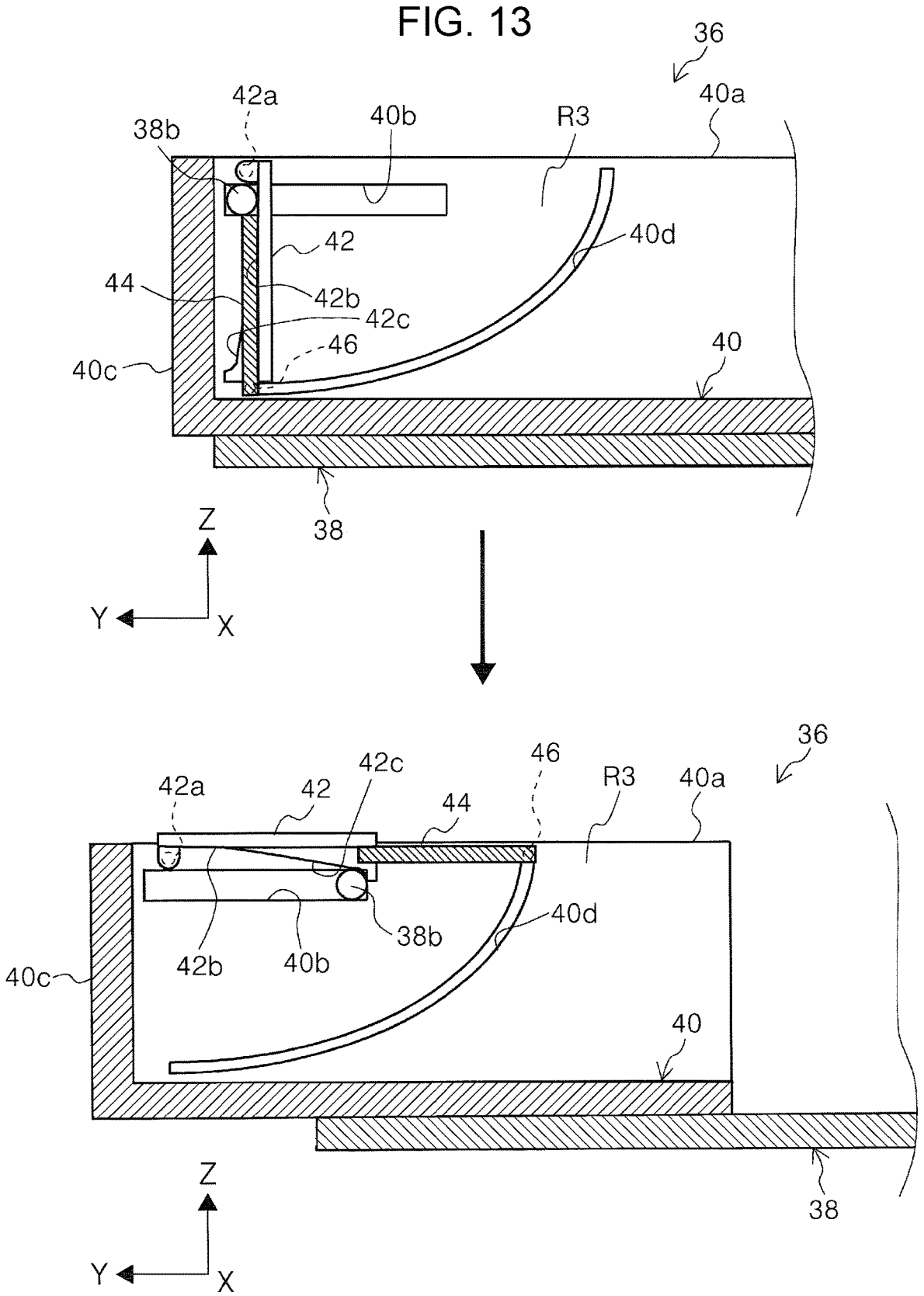
FIG. 13 is a schematic diagram illustrating the switching between a first posture and a second posture in a modification example of a cover according to the third embodiment.
Figure 14:
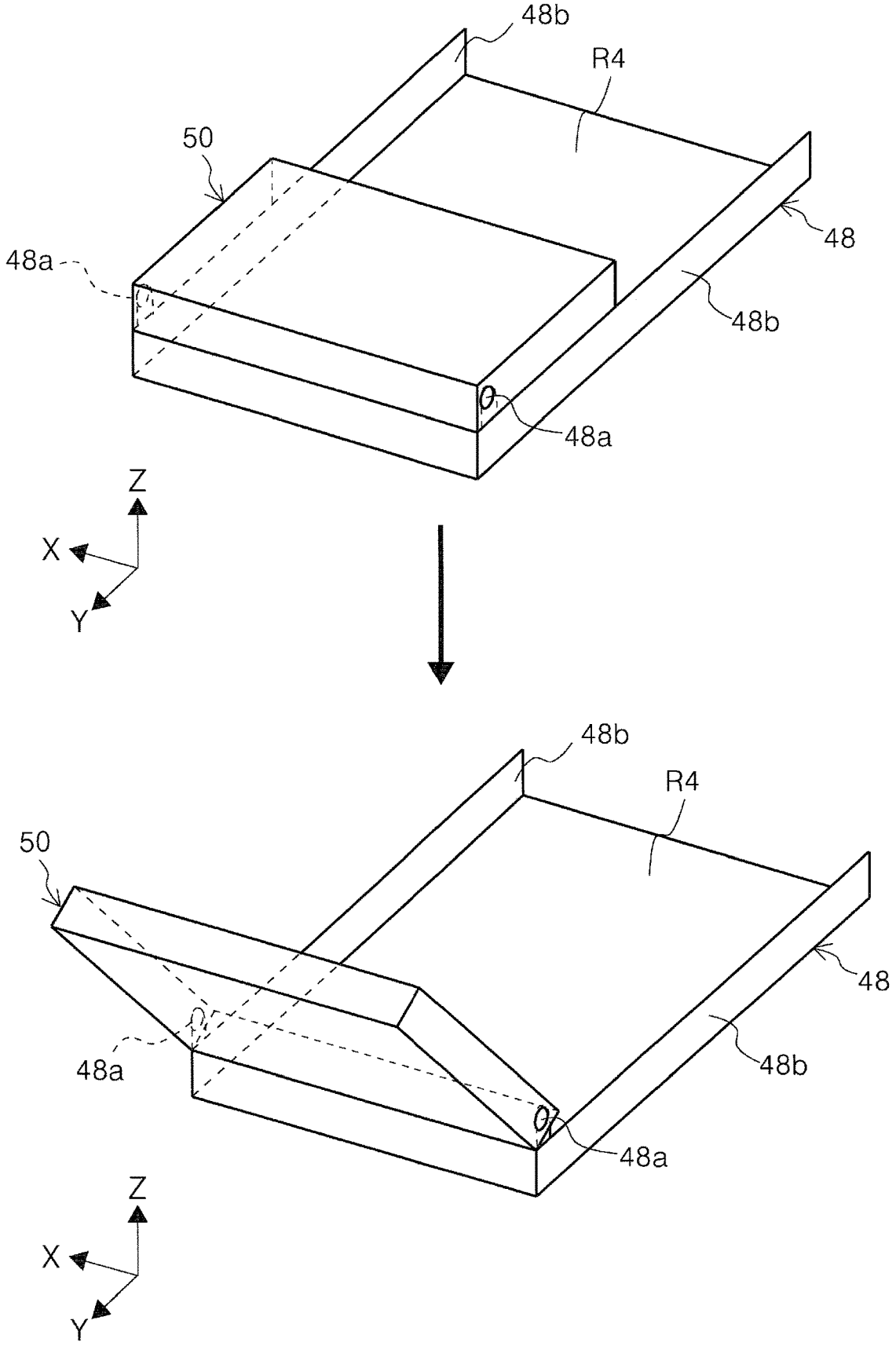
FIG. 14 is a schematic diagram illustrating the switching between a first posture and a second posture of a cover according to a fourth embodiment.
Figure 15:
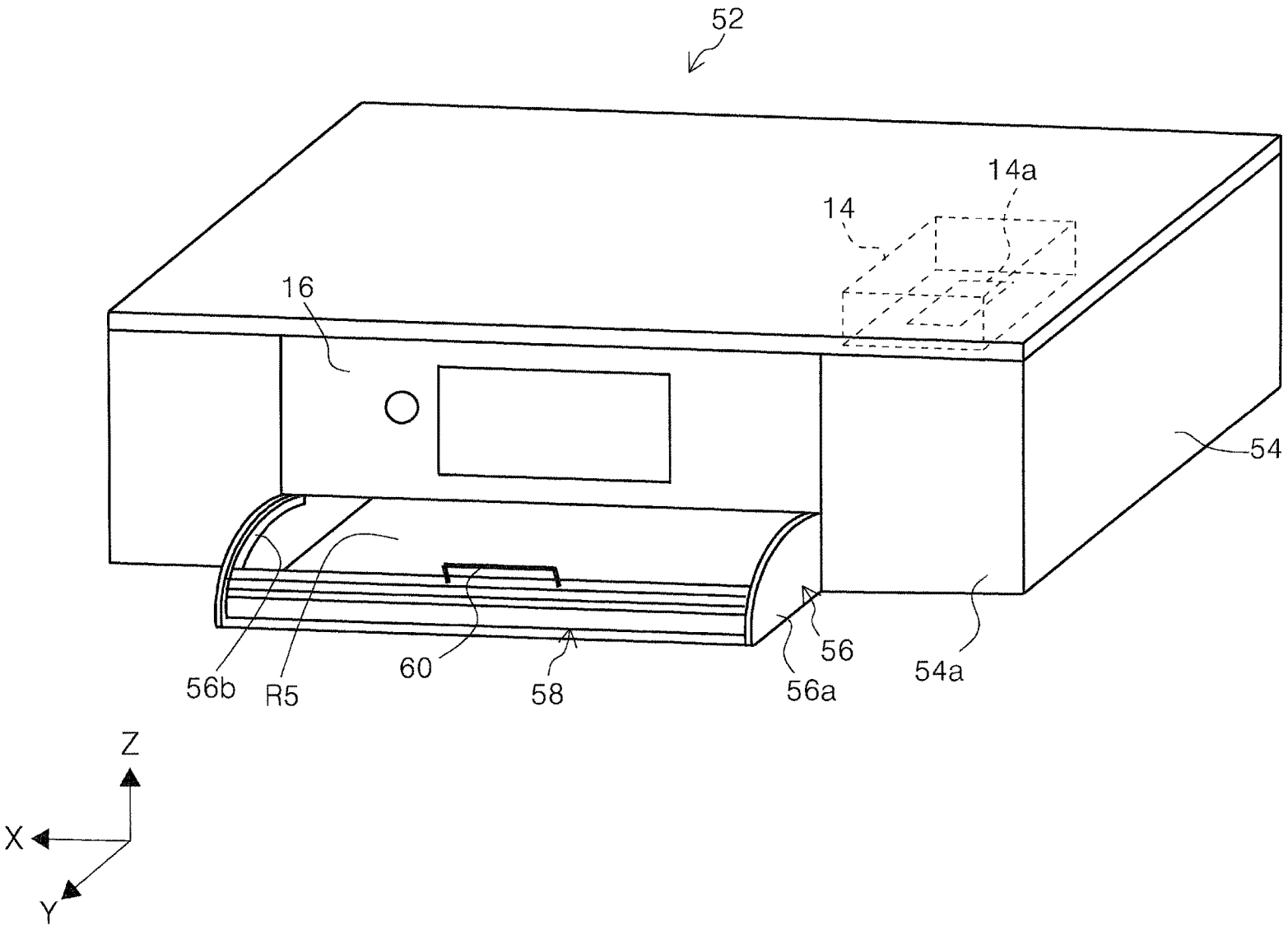
FIG. 15 is a perspective view illustrating a first posture of a cover in a printer according to a fifth embodiment.
Figure 16:
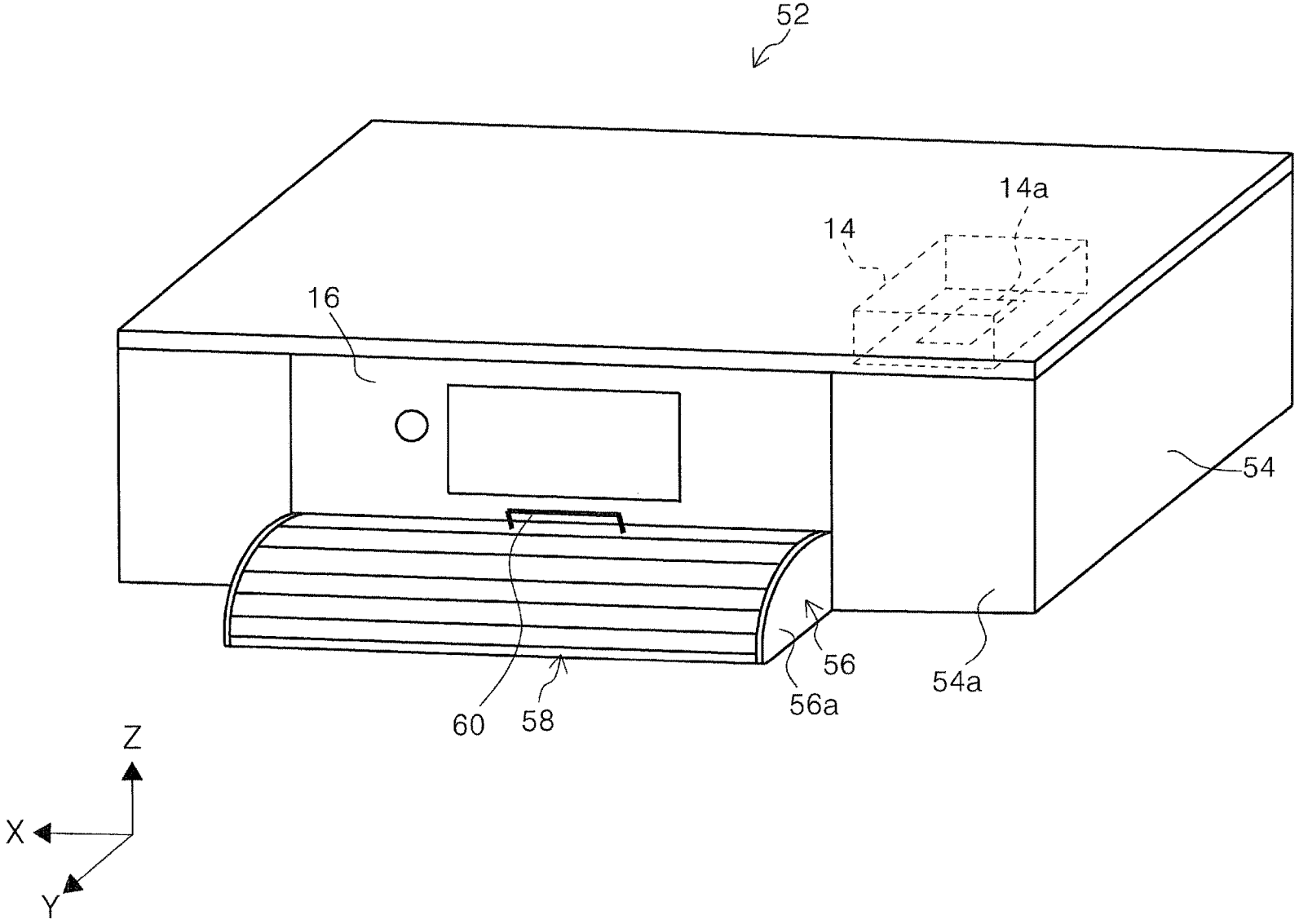
FIG. 16 is a perspective view illustrating a second posture of the cover in the printer according to the fifth embodiment.
Figure 17:
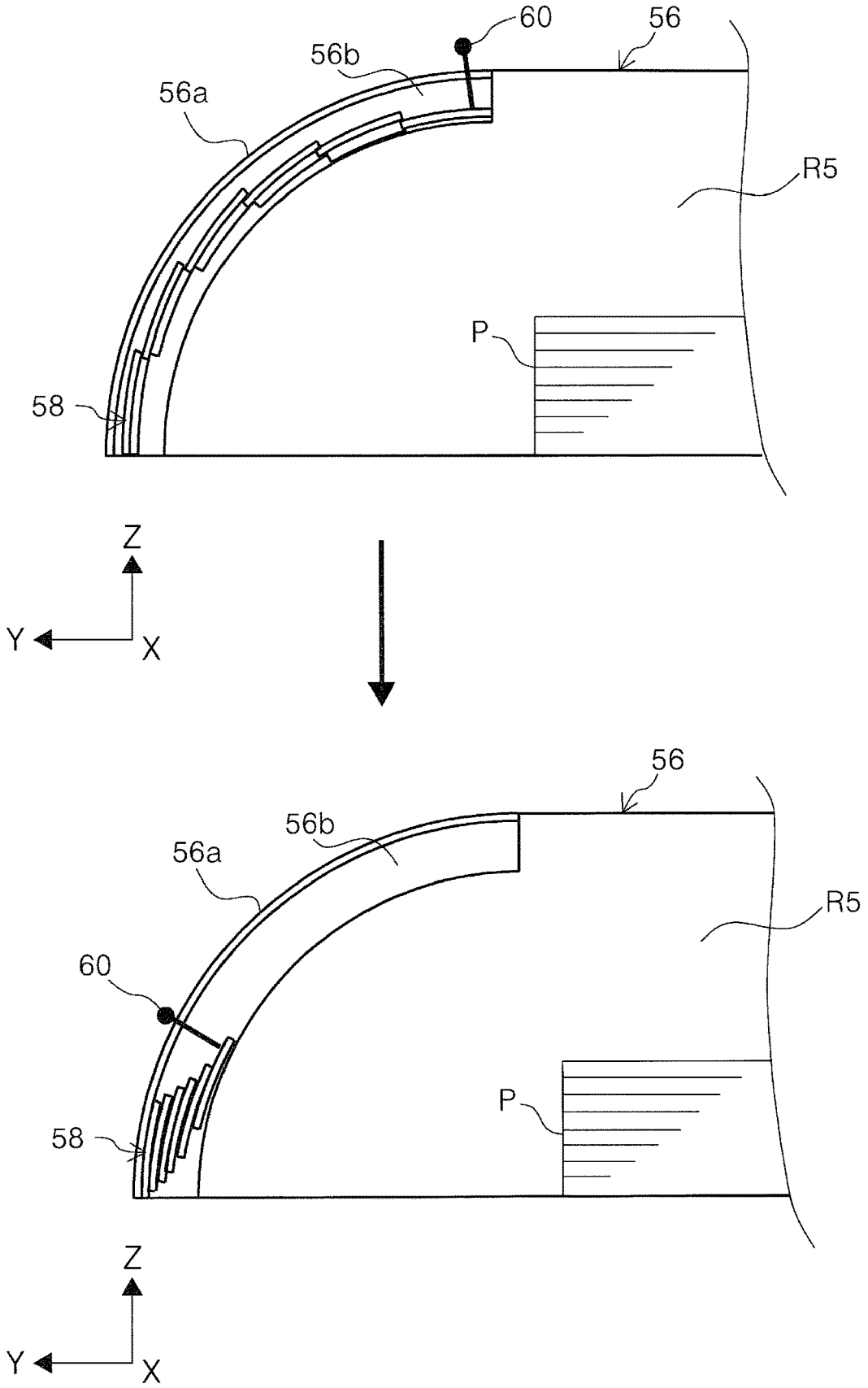
FIG. 17 is a schematic diagram illustrating the switching between the first posture and the second posture of the cover according to the fifth embodiment.

FIG. 13 is a schematic diagram illustrating the switching between a first posture and a second posture in a modification example of a cover according to the third embodiment, FIG. 14 is a schematic diagram illustrating the switching between a first posture and a second posture of a cover according to a fourth embodiment, FIG. 15 is a perspective view illustrating a first posture of a cover in a printer according to a fifth embodiment, FIG. 16 is a perspective view illustrating a second posture of the cover in the printer according to the fifth embodiment, and FIG. 17 is a schematic diagram illustrating the switching between the first posture and the second posture of the cover according to the fifth embodiment.

Figure 18:
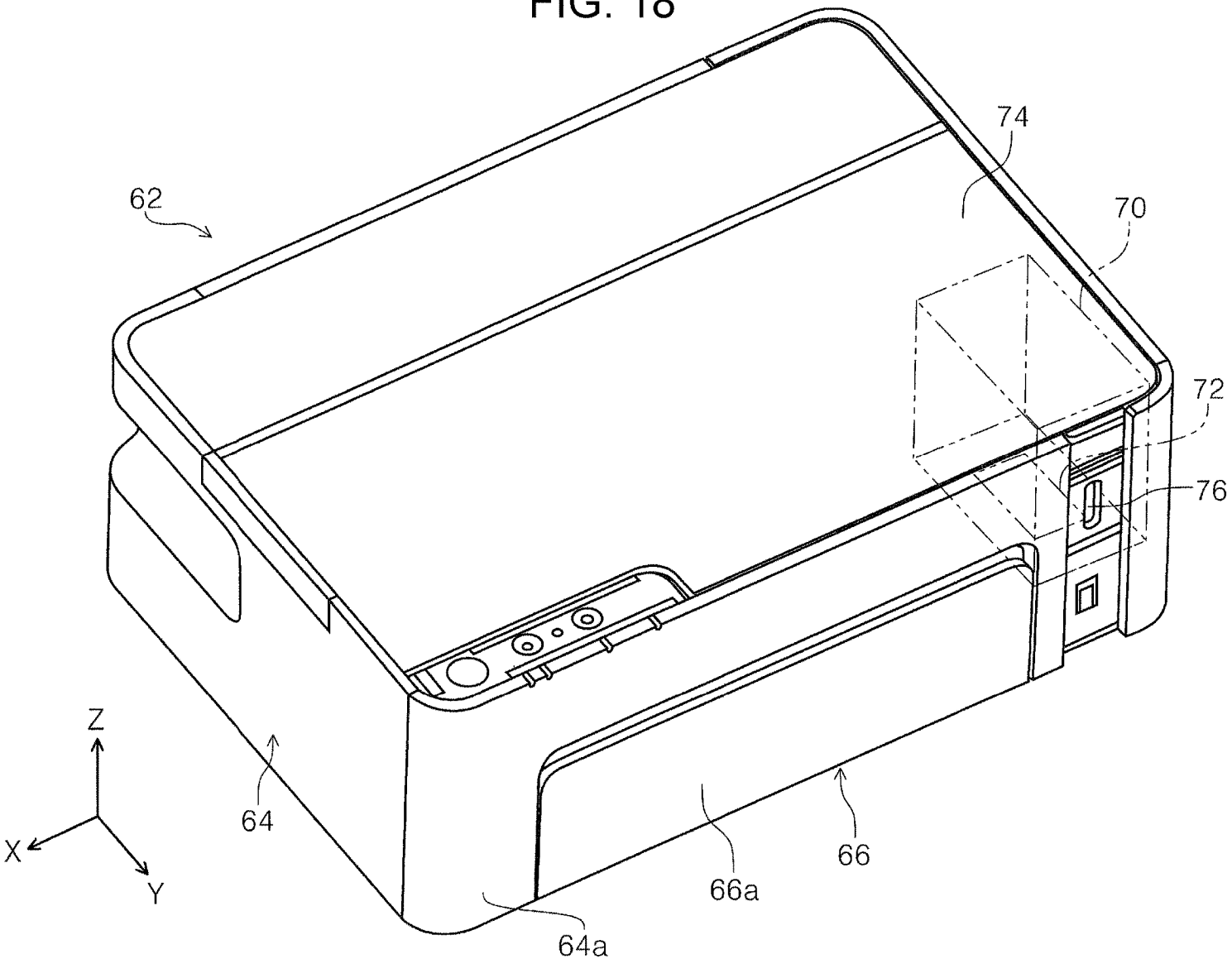
FIG. 18 is an external perspective view illustrating a storage state of a feed tray in a printer according to a sixth embodiment.
Figure 19:
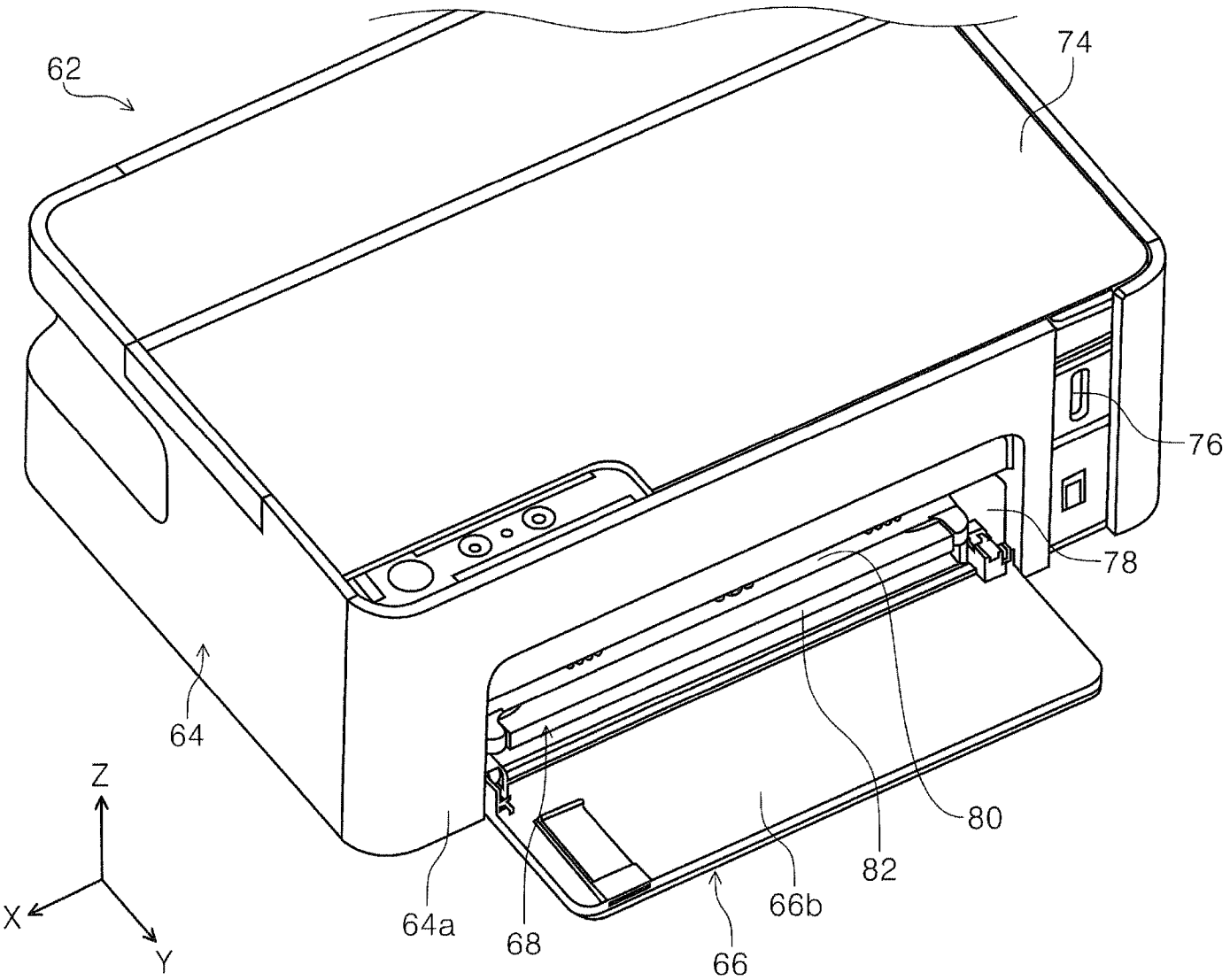
FIG. 19 is an external perspective view illustrating an extended state of a feed tray in the printer according to the sixth embodiment.
Figure 20:
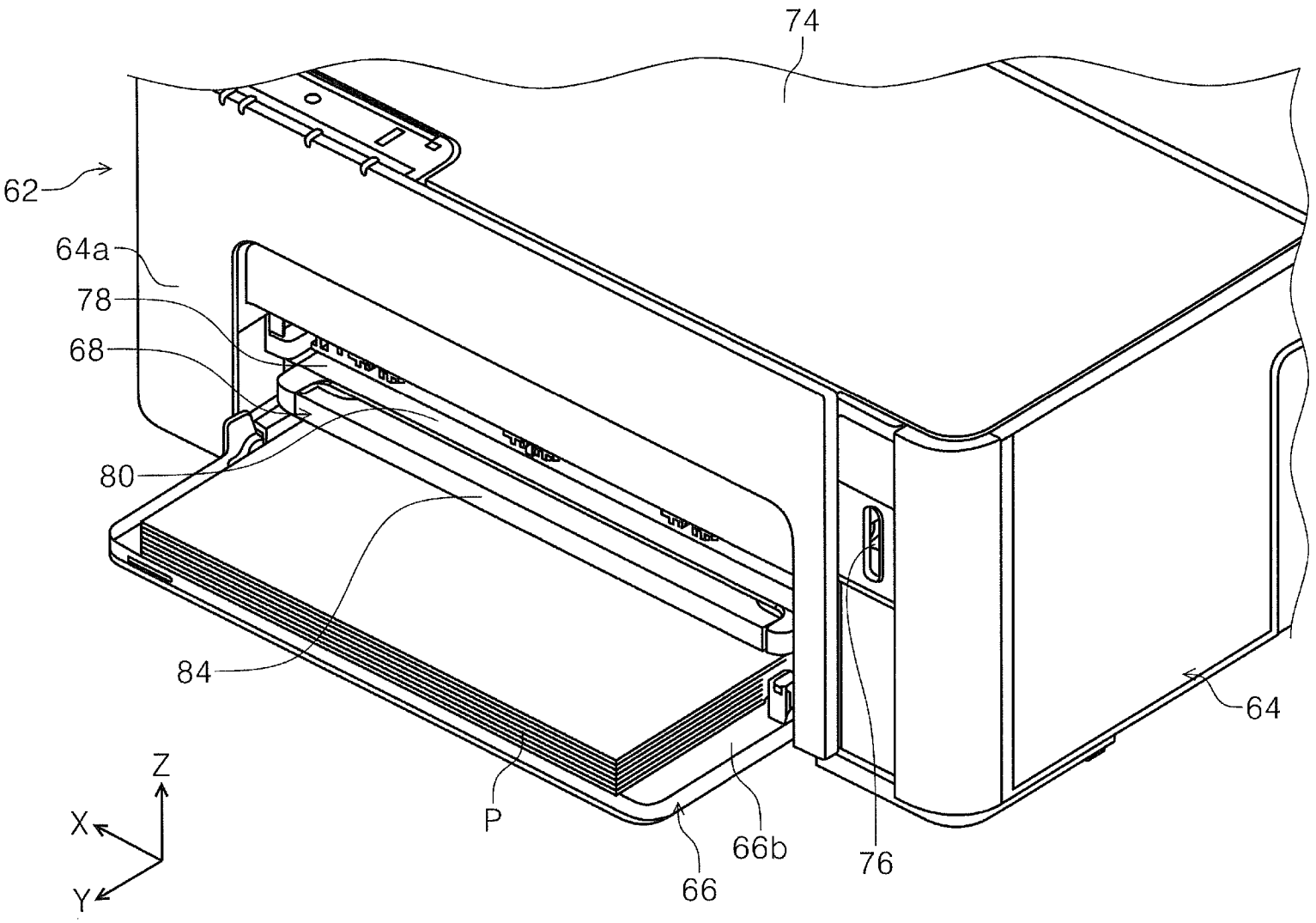
FIG. 20 is a perspective view illustrating a state in which a medium is set in the feed tray in the extended state.

FIG. 18 is an external perspective view illustrating a storage state of a feed tray in a printer according to a sixth embodiment, FIG. 19 is an external perspective view illustrating an extended state of a feed tray in the printer according to the sixth embodiment, and FIG. 20 is a perspective view illustrating a state in which a medium is set in the feed tray in the extended state.

Figure 21:
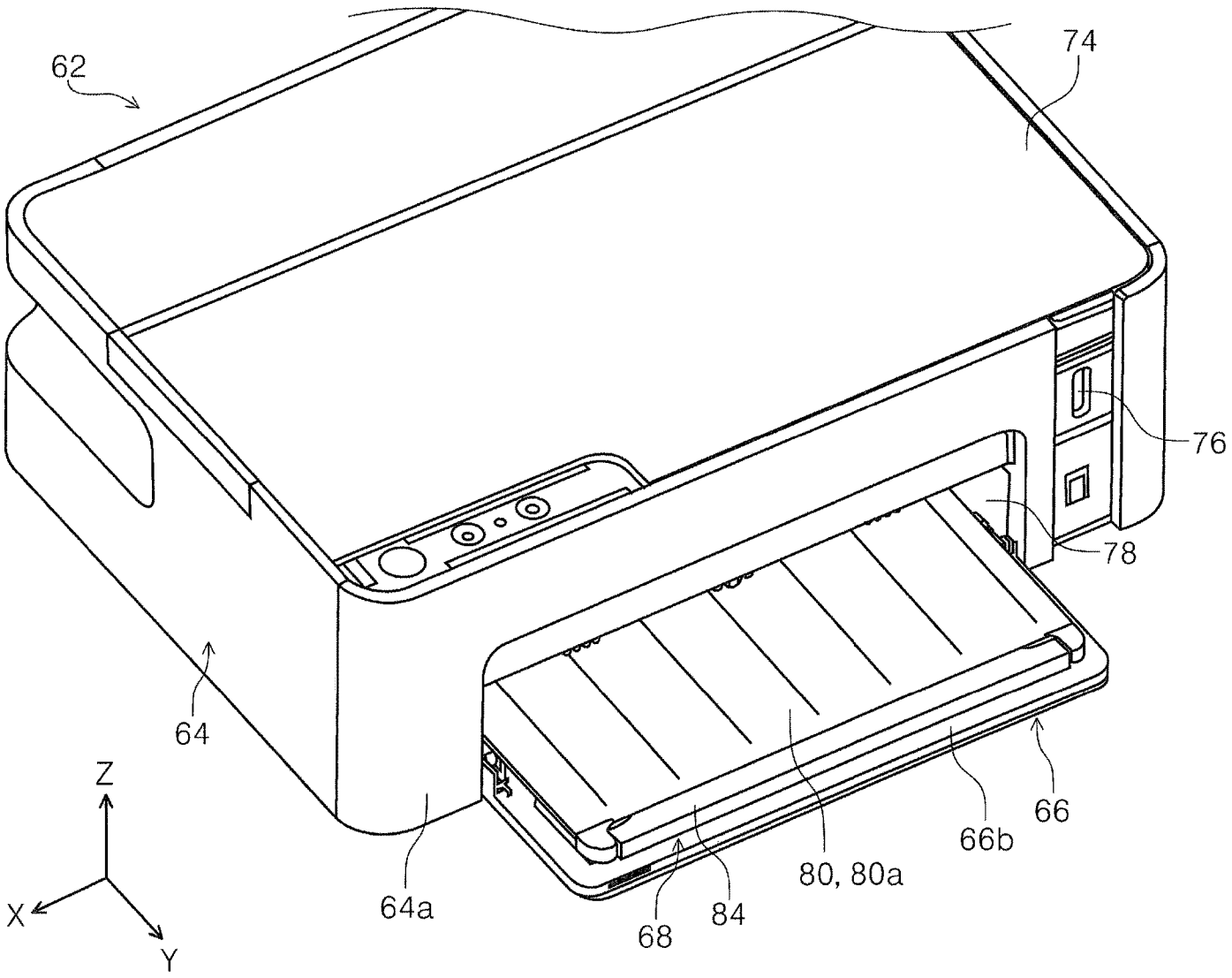
FIG. 21 is a perspective view illustrating a state in which a base tray is extended from an apparatus main body.
Figure 22:
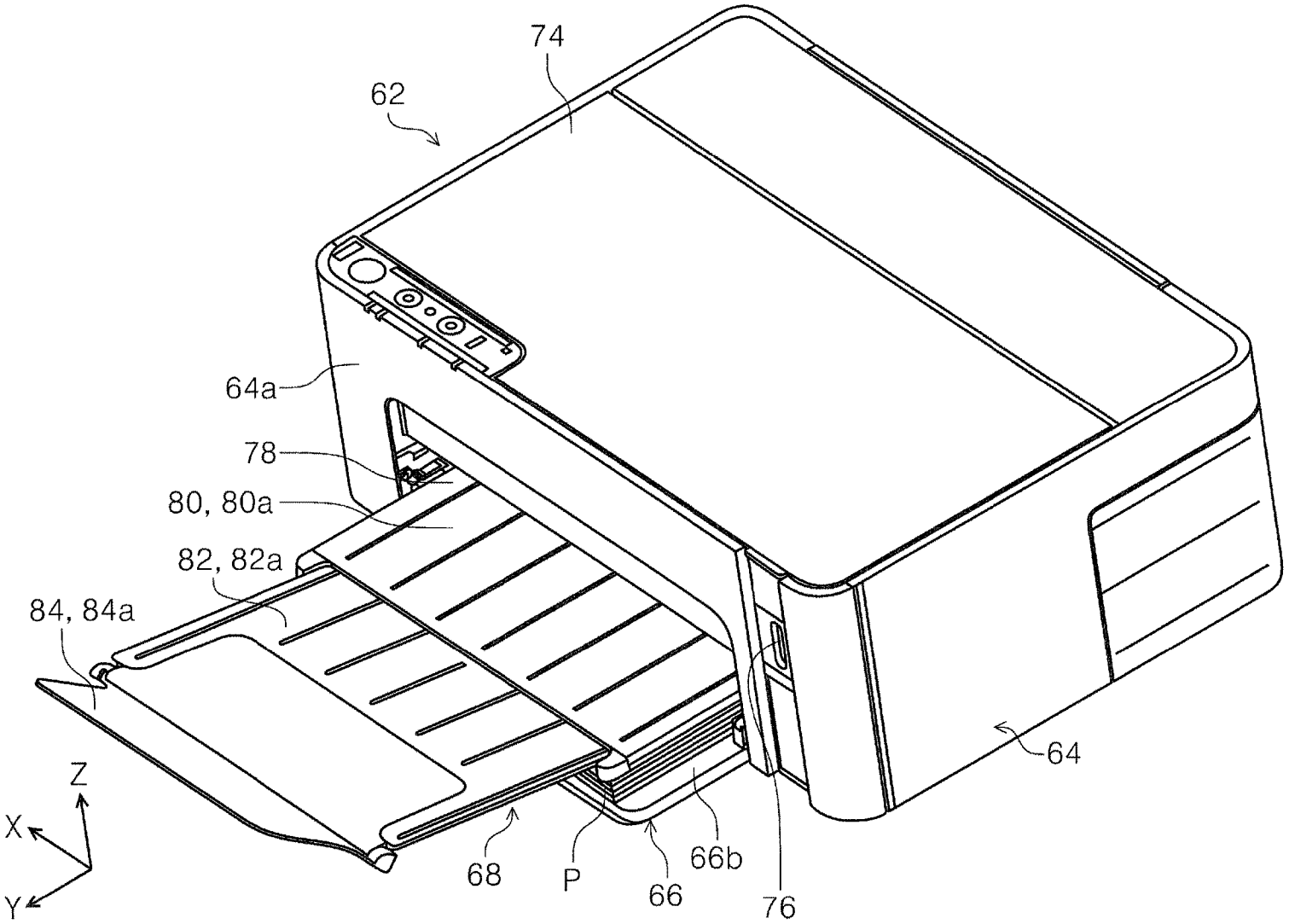
FIG. 22 is a perspective view illustrating a state in which the base tray and a sub-tray are extended from the apparatus main body.
Figure 23:
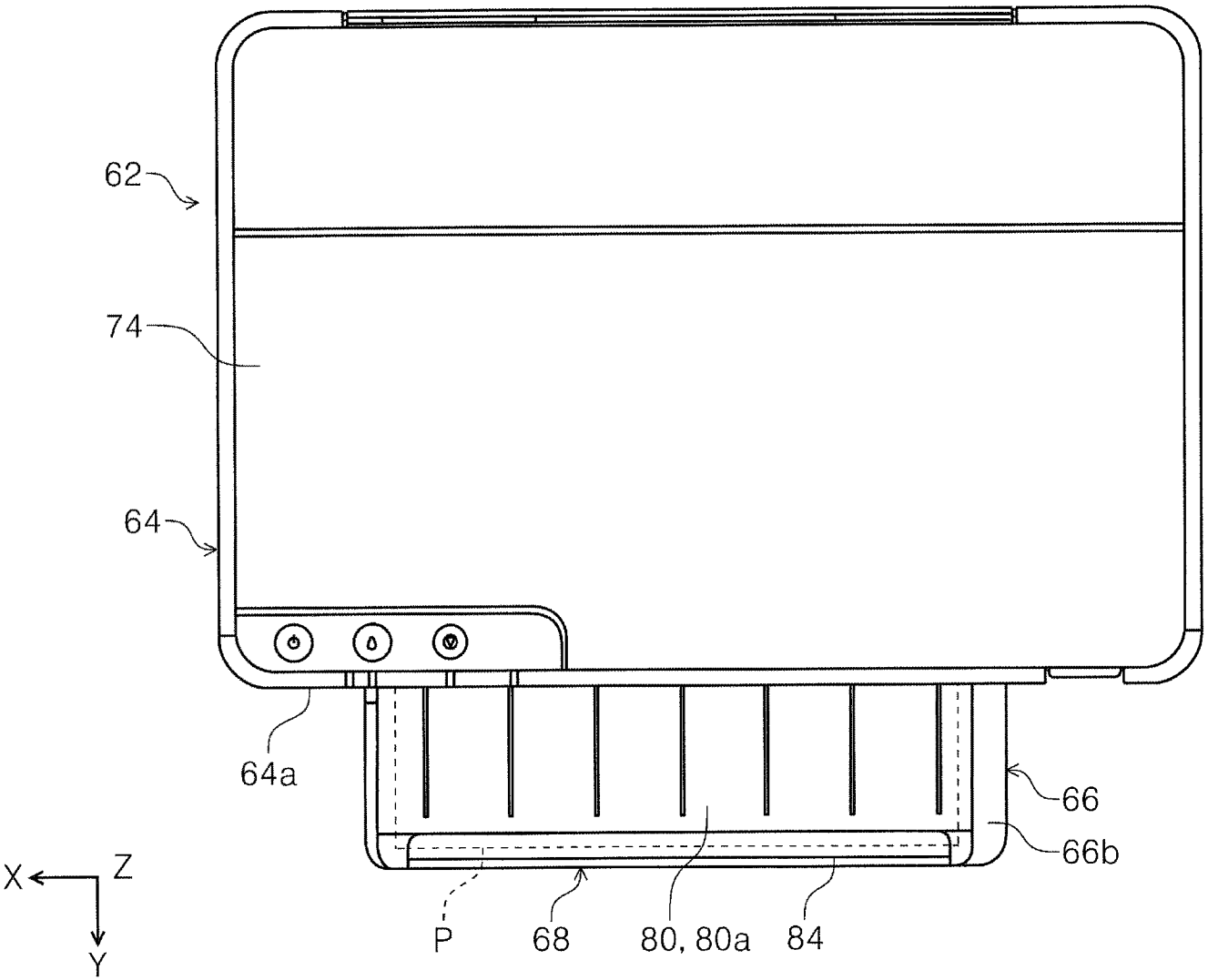
FIG. 23 is a plan view illustrating a relationship between the feed tray and a medium receiving tray.
Figure 24:
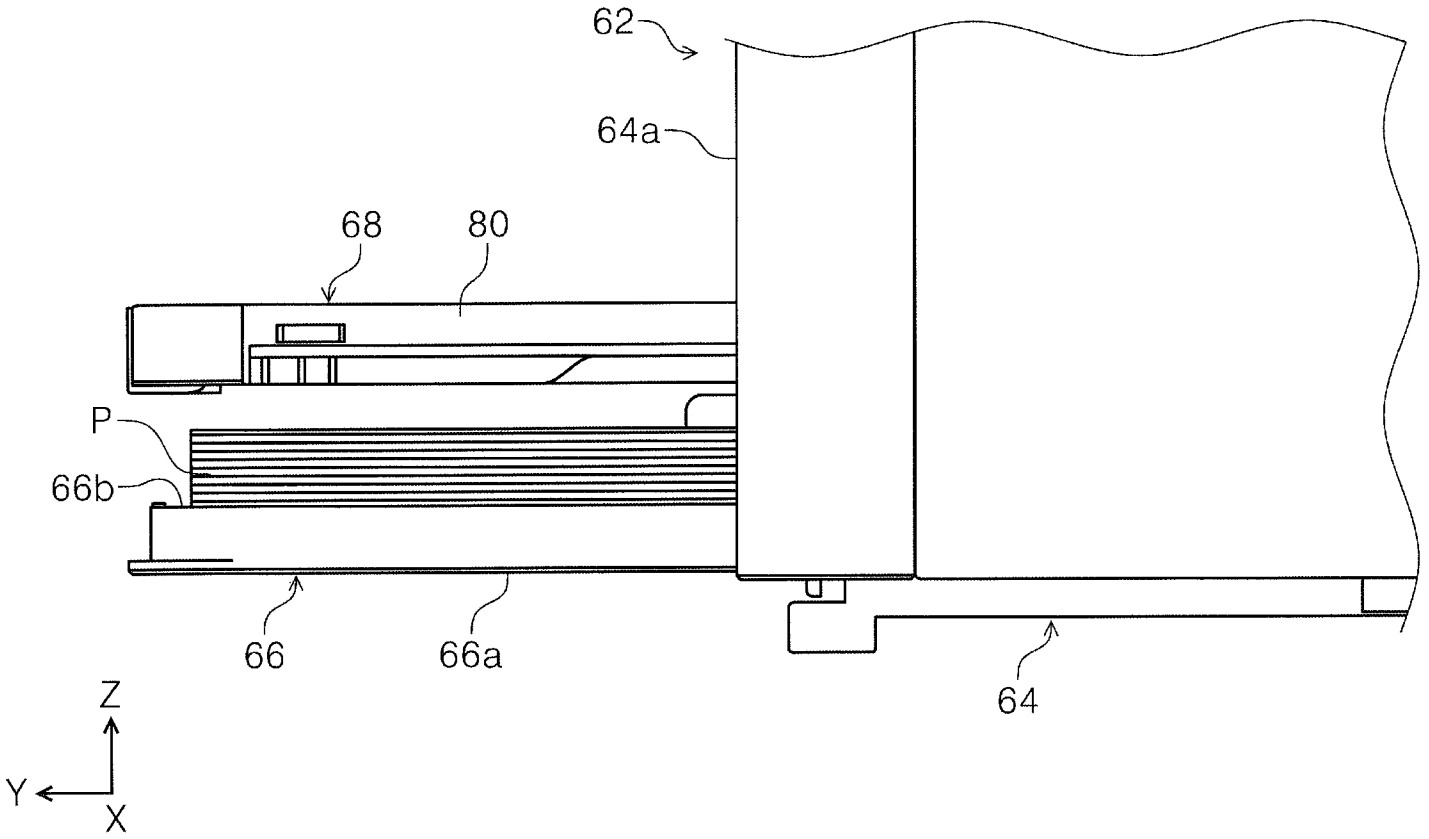
FIG. 24 is a plan view illustrating a relationship between the feed tray and a medium receiving tray.

FIG. 21 is a perspective view illustrating a state in which a base tray is extended from an apparatus main body, FIG. 22 is a perspective view illustrating a state in which the base tray and a sub-tray are extended from the apparatus main body, FIG. 23 is a plan view illustrating a relationship between the feed tray and a medium receiving tray, and FIG. 24 is a plan view illustrating a relationship between the feed tray and a medium receiving tray.

In the X-Y-Z coordinate system illustrated in the drawings, an X-direction indicates a width direction of the medium storage cassette, that is, the apparatus width direction, a Y-direction indicates an attachment-detachment direction of the medium storage cassette with respect to the apparatus main body, that is, the apparatus depth direction, and a Z-direction indicates the apparatus height direction. In the drawings, a +Y-direction is a removal direction of the medium storage cassette and a −Y-direction is an attachment direction of the medium storage cassette.

First Embodiment

Outline of Printer

In FIGS. 1 and 2, a printer 10 is provided with an apparatus main body 12, a recording unit 14, a panel unit 16, a medium support tray 18, and a medium storage cassette 20. In this embodiment, the recording unit 14 is configured as a carriage capable of moving in the apparatus width direction (the X-axis direction). A recording head 14*a* capable of discharging an ink is provided on the bottom portion of the recording unit 14.

In this embodiment, the panel unit 16 is configured to be capable of rotational movement with respect to the apparatus main body 12. The panel unit 16 is capable of switching between a posture (the posture illustrated in FIGS. 1 and 2) in which the panel unit 16 configures a portion of a front surface 12*a* of the apparatus main body 12 and a posture (the posture illustrated in FIGS. 4 and 5 in which the panel unit 16 is rotationally moved toward the front side of the apparatus main body 12.

The medium support tray 18 is configured to be capable of switching between a state (not illustrated) of being stored inside the apparatus main body 12 and a state (the double-dashed line portion in FIG. 1) of being extended to the apparatus front side of the apparatus main body 12. The medium support tray 18 is capable of extending to the apparatus front side from inside the apparatus main body 12 in a state in which the panel unit 16 is rotationally moved to the front side with respect to the apparatus main body 12. The medium support tray 18 is configured to be capable of holding a medium on which recording is performed in the recording unit 14 and which is discharged. In this embodiment, the medium support tray 18 is configured to be capable of being displaced between a position of the storage state and a position of the extended state by a drive source (a drive motor) (not illustrated) which is provided inside the apparatus main body 12.

Medium Storage Cassette

In this embodiment, the medium storage cassette 20 is disposed on the bottom side of the medium support tray 18 in the apparatus height direction. The medium storage cassette 20 is configured to be attachable and detachable with respect to the apparatus main body 12 from the front surface 12*a* of the apparatus main body 12 in the apparatus depth direction.

In a state in which the medium storage cassette 20 is completely installed in the apparatus main body 12, an opening 21 is formed in the front surface 12*a* of the apparatus main body 12. Specifically, the opening 21 is provided between the panel unit 16 and the medium storage cassette 20 in the apparatus height direction. According to this embodiment, since the opening 21 is formed above the medium storage cassette 20, when removing the medium storage cassette 20 which is installed in the apparatus main body 12, it becomes easier for a user to grasp the medium storage cassette 20 with fingers by inserting the fingers into the opening 21 and it is possible to improve the manipulability when removing the medium storage cassette. A configuration may be adopted in which the opening 21 is not provided.

As illustrated in the top portion and the bottom portion of FIG. 3, the medium storage cassette 20 is provided with a main cassette unit 22 and a sub-cassette unit 24. The main cassette unit 22 and the sub-cassette unit 24 form a medium storage region R1 on the inside thereof. As illustrated in FIG. 4, for example, a plurality of sheets of media P may be stored in the medium storage region R1. In this embodiment, the medium P includes media of different sizes such as A4 size and B5 size paper, photographic paper, postcards, and the like.

In this embodiment, the sub-cassette unit 24 is positioned on the front side in the apparatus depth direction (the removal direction) with respect to the main cassette unit 22. The sub-cassette unit 24 is configured to be capable of switching between the first state illustrated in the top portion of FIG. 3 and the second state illustrated in the bottom portion of FIG. 3 with respect to the main cassette unit 22.

The base portion of the main cassette unit 22 is provided with a first engagement portion 22*a* and a second engagement portion 22*b*. In this embodiment, the first engagement portion 22*a* and the second engagement portion 22*b* are provided as opening portions in the base portion of the main cassette unit 22, for example. The second engagement portion 22*b* is provided at a position distanced from the first engagement portion 22*a* in the apparatus depth direction by a distance L1 to the front side (the +Y-direction side) in the apparatus depth direction.

The sub-cassette unit 24 is provided with a locking portion 24*a* which extends toward the rear side in the apparatus depth direction. For example, the locking portion 24*a* is formed in a hook shape which protrudes to the top side in the apparatus height direction and is configured to be capable of engaging with the first engagement portion 22*a* or the second engagement portion 22*b*.

Specifically, in the top portion of FIG. 3, the locking portion 24*a* of the sub-cassette unit 24 is in a state (the first state) of being engaged with the first engagement portion 22*a* of the main cassette unit 22. In this state, the main cassette unit 22 and the sub-cassette unit 24 form the medium storage region R1. When moving the sub-cassette unit 24 to the front side in the apparatus depth direction from the first state to the second state, the locking portion 24*a* leaves the first engagement portion 22*a* and the engagement state between the first engagement portion 22*a* and the locking portion 24*a* is released. As a result, it is possible to move the sub-cassette unit 24 to the front side in the apparatus depth direction with respect to the main cassette unit 22.

In the bottom portion of FIG. 3, when the sub-cassette unit 24 is moved by the distance L1 to the front side in the apparatus depth direction, the locking portion 24*a* enters the second engagement portion 22*b* and the locking portion 24*a* and the second engagement portion 22*b* assume the engagement state. As a result, the sub-cassette unit 24 assumes the second state with respect to the main cassette unit 22. Here, the sub-cassette unit 24 is displaced from a non-protruding state (FIG. 1) to a protruding state (FIG. 2) with respect to the front surface 12*a* of the apparatus main body 12 (the side surface of the front side of the apparatus main body 12). As illustrated in FIG. 1, the sub-cassette unit 24 is the same surface as the front surface 12*a* of the apparatus main body 12 in the non-protruding state and configures a portion of the front surface 12*a* of the apparatus main body 12.

In the medium storage region R1, as the sub-cassette unit 24 moves by the distance L1 to the front side in the apparatus depth direction with respect to the main cassette unit 22, the storage region of the medium expands and becomes a medium storage region R1-1. Therefore, it becomes possible to store a medium of a greater than or equal size in the medium storage region R1-1 to that of the medium which is stored in the medium storage region R1.

In this embodiment, a cover 26 is provided above the main cassette unit 22 and the sub-cassette unit 24 in the apparatus height direction. The cover 26 is configured to be capable of sliding movement in the apparatus depth direction. A grip recessed portion 26*a* (FIG. 2) is provided on the front side end portion of the cover 26 in the apparatus depth direction (the free end of the cover 26).

A cover engagement portion 24*b* is provided on the top portion of the sub-cassette unit 24. A pushing member 28 is provided between the cover 26 and the apparatus main body 12. In this embodiment, the pushing force of the pushing member 28 acts in a direction in which the cover 26 is pushed against the cover engagement portion 24*b*. In this embodiment, the pushing member 28 is configured as a compressed spring, for example. As illustrated in the top portion of FIG. 3, the pushing member 28 is configured to overlap the cover 26 and the sub-cassette unit 24 (the medium storage cassette 20), more specifically, to overlap the cover engagement portion 24*b* in a region A in the apparatus height direction.

When the sub-cassette unit 24 is in the first state with respect to the main cassette unit 22 (the top portion of FIG. 3), the cover 26 is in a state of being pushed into the apparatus main body 12 by the cover engagement portion 24*b* of the sub-cassette unit 24 against the pushing force of the pushing member 28. In this state, since the cover 26 is in a state of being stored inside the apparatus main body 12 together with the sub-cassette unit 24, the grip recessed portion 26*a* is in a non-exposed state.

When the sub-cassette unit 24 switches from the first state (the top portion of FIG. 3) to the second state (the bottom portion of FIG. 3) with respect to the main cassette unit 22, the cover 26 is displaced to the front side in the apparatus depth direction in accordance with the sub-cassette unit 24 in a state of being pushed against the cover engagement portion 24*b* using the pushing force of the pushing member 28. As a result, the cover assumes a state (FIG. 2) in which the cover 26 covers a protruding portion (a portion of the front side in the apparatus depth direction) of the sub-cassette unit 24 which protrudes from the front surface 12*a* side of the apparatus main body 12. In this state, the grip recessed portion 26*a* of the cover 26 is exposed.

Since the grip recessed portion 26*a* of the cover 26 is exposed, the user is capable of manipulating the grip recessed portion 26*a* to push the cover 26 into the apparatus main body 12 against the pushing force of the pushing member 28. Accordingly, it is possible to go from a state in which the top portion of the sub-cassette unit 24 is covered by the cover 26 to a state in which the cover 26 is pushed into the apparatus main body 12 and is opened. As a result, the user is capable of accessing the medium storage region R1-1 (the bottom portion of FIG. 3) of the medium storage cassette 20 and is capable of supplying the medium to the inside of the medium storage region R1-1.

To summarize the description, the printer 10 includes the recording unit 14 which performs recording on a medium, and the medium storage cassette 20 which includes the medium storage region R1 which stores the medium, is attachable and detachable with respect to the apparatus main body 12 which is provided with the recording unit 14, and is configured such that the medium storage region R1 is capable of expanding and contracting along the apparatus depth direction, in which the medium storage cassette 20 includes the main cassette unit 22 which forms a portion of the medium storage region R1, and the sub-cassette unit 24 which is positioned on the front side in the apparatus depth direction which is in the removal direction from the apparatus main body 12 of the medium storage cassette 20 with respect to the main cassette unit 22 and is capable of switching between the first state and the second state which is displaced more in the front side in the apparatus depth direction which is the removal direction than in the first state to expand the medium storage region R1, and in which the apparatus main body 12 includes the cover 26 which is provided to be capable of being displaced between the first cover position corresponding to the first state of the sub-cassette unit 24 and the second cover position corresponding to the second state and which covers a portion of a top portion of the front side in the apparatus depth direction which is the removal direction of the medium storage region R1.

In this configuration, since the apparatus main body 12 of the printer 10 is provided with the cover 26 which is provided to be capable of being displaced between the first cover position corresponding to the first state of the sub-cassette unit 24 and the second cover position corresponding to the second state and which covers a portion of a top portion of the front side in the apparatus depth direction which is the removal direction of the medium storage region R1, whether the state of the sub-cassette unit 24 is the first state or the second state, it is possible to suitably cover the top portion of the front side in the apparatus depth direction which is the removal direction of the medium storage region R1.

The cover 26 overlaps a portion of the medium storage cassette 20 in the apparatus height direction, specifically, overlaps the cover engagement portion 24*b* of the sub-cassette unit 24 in the region A. In this configuration, it is possible to suppress the apparatus dimensions in the apparatus height direction.

The printer 10 further includes the pushing member 28 which pushes the cover 26 toward the second cover position, in which the cover 26 is displaced in accordance with state switching of the sub-cassette unit 24 due to a pushing force of the pushing member 28. In this configuration, it is not necessary to manipulate the cover 26 and the usability of the medium storage cassette 20 is improved.

The cover 26 includes the grip recessed portion 26*a* on a free end of the front side in the apparatus depth direction which is the removal direction, when the medium storage cassette 20 is completely installed in the apparatus main body 12 and the sub-cassette unit 24 assumes the first state, the medium storage cassette 20 assumes a non-protruding state from the front surface 12*a* which is a side surface of a front side of the apparatus main body 12, and when the medium storage cassette 20 is completely installed in the apparatus main body 12 and the sub-cassette unit 24 assumes the second state, the medium storage cassette 20 protrudes from the front surface 12*a* which is the side surface of the front side of the apparatus main body 12 and the grip recessed portion 26*a* is exposed.

In this configuration, when the medium storage cassette 20 is completely installed in the apparatus main body 12 and the sub-cassette unit 24 assumes the second state, since the medium storage cassette 20 protrudes from the front surface 12*a* which is the side surface of the front side of the apparatus main body 12 and the grip recessed portion 26*a* is exposed, it is possible to store the medium P by manipulating the cover 26 without removing the medium storage cassette 20 from the apparatus main body 12 when the sub-cassette unit 24 is in the second state.

Modification Example of First Embodiment (1) In this embodiment, the cover 26 is configured to be linked to the sub-cassette unit 24 through the pushing force of the pushing member 28. However, instead of this configuration, a configuration may be adopted in which the operations of the cover 26 and the sub-cassette unit 24 are performed independently. A description will be given of the specific configuration in FIGS. 4 and 5. In FIGS. 4 and 5, the configuration of the medium storage cassette 20, the main cassette unit 22, and the sub-cassette unit 24 is similar to the configuration in the first embodiment.

As illustrated in FIGS. 4 and 5, a cover 30 is provided above the medium storage cassette 20. The cover 30 is configured to be capable of switching between a state (FIG. 4) of being stored inside the apparatus main body 12 and a state (FIG. 5) of being extended to the apparatus front side from the apparatus main body 12 to cover the top portion of the sub-cassette unit 24 which protrudes to the apparatus front side by using a drive source (not illustrated) which is provided inside the apparatus main body 12, for example. The drive source (not illustrated) may share the drive source and the driving force which drives the medium support tray 18.

(2) In this embodiment, the cover 26 is configured to be linked to the sub-cassette unit 24 through the pushing force of the pushing member 28 or the cover 30 is configured using a drive source (not illustrated). However, a configuration may be adopted in which the covers 26 and 30 are moved manually by the user with respect to the medium storage cassette 20.

(3) In this embodiment, the sub-cassette unit 24 is configured to be capable of moving between the first state and the second state with respect to the main cassette unit 22. In this embodiment, only the position illustrated in the bottom portion of FIG. 3 is provided for the second state. However, for the pulled-out position in the second state, in addition to the position illustrated in the bottom portion of FIG. 3, a plurality of pulled-out positions for pulling out the sub-cassette unit 24 in the front side direction in the apparatus depth direction may be provided. The same applies to the third embodiment which will be described later.

(4) In this embodiment, the sub-cassette unit 24 is configured to form the same surface as the front surface 12*a* of the apparatus main body 12 in the non-protruding state. However, the sub-cassette unit 24 may protrude from the front surface 12*a*. The same applies to the third embodiment which will be described later.

The cover 30 obtains a motive force from a motor and is displaced. In this configuration, since the cover 30 obtains the motive force of the motor and is displaced, it is possible to cover the top portion of the apparatus front side of the medium storage region R1 without the user manipulating the cover 30, and the usability of the medium storage cassette 20 is improved.

Second Embodiment

Next, a description will be given of the second embodiment of the medium storage cassette in FIGS. 6 to 9. In FIGS. 6 and 7, a medium storage cassette 32 is formed as a box-shaped body in which the top side in the apparatus height direction is open. The inside of the medium storage cassette 32 is configured as a medium storage region R2. A recessed portion 32*b* which is recessed further to the bottom side in the apparatus height direction than a base surface 32*a* is formed in the base surface 32*a* of the medium storage cassette 32. The base surface 32*a* functions as a placement surface of the medium P which is stored inside the medium storage region R2. A pair of side walls 32*c* which extend in the apparatus depth direction and protrude upward in the apparatus height direction from the base surface 32*a* are provided on both end portions in the apparatus width direction (the X-axis direction) of the medium storage cassette 32.

In FIG. 7, guide grooves 32*d* which extend in the apparatus depth direction are provided in the side walls 32*c*. Rotational movement allowance portions 32*e* are provided on both end portions of each of the guide grooves 32*d* in the apparatus depth direction. The rotational movement allowance portions 32*e* extend toward the top side in the apparatus height direction and are open at the top in the apparatus height direction.

A cover 34 is attached to the pair of side walls 32*c* to be capable of slide movement in the apparatus depth direction. In this embodiment, the cover 34 is configured to cover at least the top portion of a portion of the medium storage region R2 at the end portion on the front side of the medium storage cassette 32 in the apparatus depth direction.

A pair of rotational movement shafts 34*a* is provided, leaving an interval therebetween in the apparatus depth direction, on each of the end portions of the cover 34 in the apparatus width direction (the X-axis direction). Specifically, the pairs of rotational movement shafts 34*a* are provided on the front side end portion and the rear side end portion in the apparatus depth direction at the end portions of the cover 34 in the apparatus width direction, respectively, and protrude toward the outside of the cover 34 in the apparatus width direction.

The rotational movement shafts 34*a* of the cover 34 are received by the guide grooves 32*d* of the side walls 32*c*. The cover 34 is capable of sliding movement in the apparatus depth direction with respect to the medium storage cassette 32 due to the rotational movement shafts 34*a* moving along the guide grooves 32*d*.

In FIG. 6, a rear end edge guide 34*b* extends from the bottom portion of the cover 34 toward the bottom side in the apparatus height direction. The rear end edge guide 34*b* restricts the position of the edge (the rear end edge) on the front side in the apparatus depth direction of the medium P which is stored in the medium storage region R2. The bottom end of the rear end edge guide 34*b* is received inside the recessed portion 32*b* of the medium storage cassette 32. Specifically, the bottom end of the rear end edge guide 34*b* is positioned at a height less than or equal to that of the base surface 32*a* of the medium storage cassette 32, that is, the placement surface of the medium.

Next, in FIG. 8, when the front side end portion of the cover 34 in the apparatus depth direction is pulled up to the top side in the apparatus height direction in a state in which the cover 34 is positioned at the front side end portion of the medium storage cassette 32 in the apparatus depth direction, the rotational movement shafts 34*a* on the front side (the +Y-direction side) of the cover 34 in the apparatus depth direction leave the rotational movement allowance portions 32*e* and are displaced to the top side in the apparatus height direction. As a result, it is possible to rotationally move the cover 34 using the rotational movement shafts 34*a* of the rear side (the −Y-direction side) in the apparatus depth direction as a fulcrum.

Next, as illustrated in the top portion of FIG. 9, the cover 34 is subjected to sliding movement to the rear side (the arrow of the top portion of FIG. 9) from a state (FIG. 6) in which the cover 34 is positioned at the front side end portion of the medium storage cassette 32 in the apparatus depth direction. When the cover 34 is displaced along the guide grooves 32*d* to the apparatus depth direction side and the rotational movement shafts 34*a* of the rear side of the cover 34 in the apparatus depth direction move to the rotational movement allowance portions 32*e* of the rear side end portions of the guide grooves 32*d* in the apparatus depth direction, the sliding movement of the cover 34 ends.

At this position, when the rear side end portion of the cover 34 in the apparatus height direction is lifted up to the top side in the apparatus height direction, the rotational movement shafts 34*a* of the rear side (the −Y-direction side) of the cover 34 in the apparatus depth direction leave the rotational movement allowance portions 32*e* and are displaced to the top side in the apparatus height direction. As a result, it is possible to rotationally move the cover 34 using the rotational movement shafts 34*a* of the front side (the +Y-direction side) in the apparatus depth direction as a fulcrum.

As illustrated in FIG. 8 and the bottom portion of FIG. 9, by rotationally moving the cover 34 from a posture in which the cover 34 covers at least a portion of the medium storage cassette 32, access to the medium storage region R2 of the medium storage cassette 32 becomes easier and it becomes easy to refill the medium storage cassette 32 with the medium.

To summarize the description, the printer 10 includes the recording unit 14 which performs recording on the medium P, and the medium storage cassette 32 which includes the medium storage region R2 which stores the medium P and is attachable and detachable with respect to the apparatus main body 12 which is provided with the recording unit 14, in which the medium storage cassette 32 includes the cover 34 which covers a top portion of a portion of the medium storage region R2, and in which the cover 34 includes the rear end edge guide 34*b* which restricts the position of the rear end edge which is an edge on the front side in the apparatus depth direction which is the removal direction of the medium P which is stored in the medium storage region R2 and the cover is provided to be capable of sliding in the apparatus depth direction which is the attachment and detachment direction.

In this configuration, since the cover 34 which covers a top portion of a portion of the medium storage region R2 includes the rear end edge guide 34*b* which restricts the position of the rear end edge which is an edge of the medium P on the front side in the apparatus depth direction which is the removal direction and the cover is provided to be capable of sliding in the apparatus depth direction which is the attachment and detachment direction, when the rear end edge guide 34*b* is aligned to the position of the rear end edge of the medium P, the cover 34 covers the top portion region, it is possible to favorably suppress adherence of dust or the like to the top portion of the stored medium P, and the usability of the medium storage cassette 32 is improved.

The bottom end portion of the rear end edge guide 34*b* is at a height less than or equal to that of the base surface 32*a* which is the medium placement surface on which the medium is placed in the medium storage region R2. In this configuration, since the bottom end portion of the rear end edge guide 34*b* is at a height less than or equal to that of the base surface 32*a* which is the medium placement surface on which the medium is placed in the medium storage region R2, it is possible to suitably restrict the rear end edge position of all of the media P which are stacked (in particular, the bottommost medium).

The cover 34 is provided to be capable of rotating using the rotational movement shafts 34*a* of the apparatus rear side of the cover 34 as a fulcrum and opens and closes a portion of the medium storage region R2 by rotating. In this configuration, it becomes easy to refill the medium storage region R2 with the medium P.

The cover 34 is provided to be capable of rotating using the rotational movement shafts 34*a* of the apparatus front side of the cover 34 as a fulcrum and opens and closes a portion of the medium storage region R2 by rotating. In this configuration, in a case in which the medium is stored at the apparatus rear side of the medium storage region R2 (for example, a case in which a medium of a small size is stored), the working properties are improved.

The cover 34 is displaced along the guide grooves 32*d* which are formed in the side walls 32*c* which are provided to extend along the displacement direction of the cover 34. In this case, it is possible to stably displace the cover 34.

Third Embodiment

Next, a description will be given of the third embodiment of the medium storage cassette in FIGS. 10 to 12. A medium storage cassette 36 is provided with a main cassette unit 38 and a sub-cassette unit 40. The main cassette unit 38 and the sub-cassette unit 40 form a medium storage region R3 on the inside thereof. Guide grooves 40*b* which extend in the apparatus depth direction are formed in side walls 40*a* of the sub-cassette unit 40 in the apparatus width direction.

A pair of engagement protrusions 38*b* which protrude toward the inside in the apparatus width direction are formed on side walls 38*a* of the main cassette unit 38 in the apparatus width direction. The engagement protrusions 38*b* are received inside the guide grooves 40*b* of the sub-cassette unit 40 and when the sub-cassette unit 40 is displaced in the apparatus depth direction with respect to the main cassette unit 38, the engagement protrusions 38*b* are displaced in the apparatus depth direction relative to the sub-cassette unit 40 along the guide grooves 40*b*.

A cover 42 is attached to the front side end portion of the sub-cassette unit 40 in the apparatus depth direction to be capable of rotational movement with respect to the sub-cassette unit 40 using rotational movement shafts 42*a* as a fulcrum.

In FIG. 10, a state in which the engagement protrusions 38*b* are positioned at the front side end portions of the guide grooves 40*b* in the apparatus depth direction is the first state of the sub-cassette unit 40 with respect to the main cassette unit 38. In the first state of the sub-cassette unit 40, the cover 42 assumes a first posture in which the cover 42 lays along a wall 40*c* of the front side of the sub-cassette unit 40 in the apparatus depth direction as illustrated in the top portion of FIG. 12.

When the sub-cassette unit 40 is pulled out to the front side in the apparatus depth direction with respect to the main cassette unit 38, the sub-cassette unit 40 is transitioned from the state illustrated in FIG. 10 to the state illustrated in FIG. 11. At this time, the engagement protrusions 38*b* move along the guide grooves 40*b* from the front side end portions to the rear side end portions of the guide grooves 40*b* in the apparatus depth direction relative to the sub-cassette unit 40 (the top portion and the bottom portion of FIG. 12).

When the engagement protrusions 38*b* move to the rear side in the apparatus depth direction relative to the sub-cassette unit 40, the engagement protrusions 38*b* engage with a bottom surface 42*b* of the cover 42. Subsequently, the engagement protrusions 38*b* move to the rear side in the apparatus depth direction along a cam shape 42*c* which is provided on the bottom surface 42*b* of the cover 42. As a result, the cover 42 stands up from the first posture in which the cover 42 lays along the wall 40*c* in accordance with the displacement of the engagement protrusions 38*b* and is switched to the second posture in which the cover 42 covers the top portion of the front side in the apparatus depth direction in the medium storage region R3.

In this embodiment, it is also possible to switch the cover 42 from the first posture (the laying down posture) to the second posture (the posture of covering the top portion of the medium storage region) by switching the sub-cassette unit 40 from the first state to the second state with respect to the main cassette unit 38, and it is also possible to switch the cover 42 from the second posture to the first posture by switching the sub-cassette unit 40 from the second state to the first state. As a result, it is possible to improve the manipulability of the medium storage cassette 36 by the user.

To summarize the description, the printer which is an example of the recording apparatus includes the recording unit 14 which performs recording on the medium P, and the medium storage cassette 36 which includes the medium storage region R3 which stores the medium P, is attachable and detachable with respect to the apparatus main body 12 which is provided with the recording unit 14, and is configured such that the medium storage region R3 is capable of expanding and contracting along the apparatus depth direction, in which the medium storage cassette 36 includes the main cassette unit 38 which forms a portion of the medium storage region R3, the sub-cassette unit 40 which is positioned on the front side in the apparatus depth direction which is in the removal direction from the apparatus main body 12 of the medium storage cassette 36 with respect to the main cassette unit 38, forms a portion of the medium storage region R3, and is capable of switching between the first state and the second state which is displaced more in the front side in the apparatus depth direction which is the removal direction than in the first state to expand the medium storage region R3, and the cover 42 which covers the top portion of the front side in the apparatus depth direction which is the removal direction in the medium storage region R3 and is provided in the sub-cassette unit 40, in which, by rotating, the cover 42 switches between a first posture in which the cover 42 is lain along the wall 40*c* on the front side in the apparatus depth direction which is the removal direction of the sub-cassette unit 40 and a second posture in which the cover 42 covers a top portion on the front side in the apparatus depth direction which is the removal direction in the medium storage region R3 by being stood up from the first posture, and in which the engagement protrusions 38*b* which engage with the cover 42 are provided on the main cassette unit 38 and by switching the sub-cassette unit 40 from the first state to the second state, the engagement protrusions 38*b* switch the cover 42 from the first posture to the second posture.

In this configuration, since the engagement protrusions 38*b* switch the cover 42 from the first posture to the second posture by switching the sub-cassette unit 40 from the first state to the second state, it is not necessary to manipulate the cover 42 itself and the usability of the medium storage cassette 36 is improved.

Modification Example of Third Embodiment

Next, a description will be given of a modification example of the medium storage cassette 36 in FIG. 13. In this modification example, an extending portion 44 which is pulled out from the cover 42 according to the rotational movement of the cover 42 is provided in the cover 42. Specifically, the extending portion 44 which is capable of sliding movement with respect to the cover 42 is attached to the bottom surface 42*b* of the cover 42. Engagement pins 46 are provided on the bottom end portion of the extending portion 44 in a case in which the cover 42 assumes the first posture. The engagement pins 46 protrude to the outside in the apparatus width direction from both end portions of the extending portion 44 in the apparatus width direction.

Guide grooves 40*d* are provided in the side walls 40*a* of the sub-cassette unit 40. The engagement pins 46 are received by the guide grooves 40*d*. When the cover 42 switches from the first posture to the second posture, the engagement pins 46 are also displaced along the guide grooves 40*d* in accordance with the rotational movement of the cover 42. The extending portion 44 is pulled out from the cover 42 in accordance with the movement. As a result, the region which is covered by the cover 42 and the extending portion 44 in the medium storage region R3 is expanded.

When the cover 42 switches from the second posture to the first posture, the engagement pins 46 are displaced along the guide grooves 40*d* to the bottom side and the extending portion 44 is stored at a position corresponding to the bottom surface 42*b* of the cover 42.

Fourth Embodiment

In FIG. 14, a description will be given of the fourth embodiment of the medium storage cassette. A medium storage cassette 48 is formed as a box-shaped member in which the top side in the apparatus height direction is open. A medium storage region R4 is formed on the inside of the medium storage cassette 48. A cover 50 is attached to the front side end portion of the medium storage cassette 48 in the apparatus depth direction to be capable of rotational movement via rotational movement shafts 48*a*. The rotational movement shafts 48*a* are provided on side walls 48*b* which extend in the apparatus depth direction on both end portions of the medium storage cassette 48 in the apparatus width direction and protrude upward in the apparatus height direction.

The cover 50 is configured to be capable of switching between a posture in which the cover 50 covers at least the front side in the apparatus depth direction of the medium storage region R4 of the medium storage cassette 48 illustrated in the top portion of FIG. 14 and a posture in which the cover 50 is rotationally moved to the front side in the apparatus depth direction with respect to the medium storage cassette 48 illustrated in the bottom portion of FIG. 14.

Although not illustrated, since a portion of the region of the front side in the apparatus depth direction in the medium storage region R4 is exposed when the cover 50 is rotationally moved with respect to the medium storage cassette 48 in a state in which the medium storage cassette 48 is installed in the printer, since it is possible to supply the medium to the medium storage cassette 48 with the medium storage cassette 48 still installed in the printer, it is possible to improve the manipulability by the user.

Fifth Embodiment

Next, a description will be given of the fifth embodiment of the medium storage cassette in FIGS. 15 to 17. A printer 52 is provided with a medium storage cassette 56 which is attachable and detachable with respect to an apparatus main body 54. A medium storage region R5 is formed on the inside of the medium storage cassette 56. In the printer 52, the configuration other than that of the medium storage cassette 56 is the same configuration as in the printer 10 of the first embodiment.

An arc-shaped cover portion 56*a* is provided on the front side of the medium storage cassette 56 in the apparatus depth direction. The arc-shaped cover portion 56*a* protrudes further to the front side in the apparatus depth direction than a front surface 54*a* of the apparatus main body 54 in a state in which the medium storage cassette 56 is installed in the apparatus main body 54.

A cover 58 is provided on the cover portion 56*a*. A handle 60 is provided on the cover 58. When the user lifts up the handle 60, the cover 58 switches from a state (FIG. 15) in which the cover 58 is lifted up and opened to a state (FIG. 16) in which the cover 58 is closed.

Specifically, as illustrated in FIG. 17, an arc-shaped guide groove 56*b* which extends from the apparatus front side to the apparatus rear side and extends from the bottom side to the top side in the apparatus height direction is formed in the cover portion 56*a*.

The cover 58 is configured by joining a plurality of members, each of which has a portion of the shape of the arc-shaped guide groove 56*b*. The joined members are configured to be capable of sliding in the direction in which the arc extends with respect to each other. In a state illustrated in FIG. 15 in which the cover 58 is open, the plurality of members of the cover 58 are stored in the bottom portion of the guide groove 56*b* so as to overlap each other as illustrated in the bottom portion of FIG. 17.

When the handle 60 is lifted up from this state, the plurality of members of the cover 58 undergo sliding movement relative to each other, move along the guide groove 56*b* to the apparatus rear side, and assume a state (FIG. 16) of covering the medium storage region R5 of the medium storage cassette 56.

Sixth Embodiment

A description will be given of the sixth example with reference to FIGS. 18 to 24. A printer 62 is provided with an apparatus main body 64, a feed tray 66, and a medium receiving tray 68. In FIG. 18, a carriage 70 is provided inside the apparatus main body 64. The carriage 70 is configured to be capable of moving in the X-axis direction inside the apparatus main body 64. In this embodiment, the position of the carriage 70 illustrated in FIG. 18 is set as the home position of the carriage 70, for example. A recording head 72 which serves as "a recording unit" capable of discharging an ink in the −Z-direction is provided the bottom portion of the carriage 70.

In this embodiment, a cover 74 is provided on the top portion of the apparatus main body 64. The cover 74 is configured to be capable of switching between a closed state (FIGS. 18 to 23) in which the cover 74 forms a portion of the top portion of the apparatus main body 64 and an open state (not illustrated) in which the cover 74 exposes the carriage 70 inside the apparatus main body 64 to allow access to the carriage 70. In this embodiment, for example, the cover 74 is configured to be capable of rotational movement with respect to the apparatus main body 64 using the −Y direction side end portion as the rotational movement fulcrum.

The carriage 70 in this embodiment is provided with an ink storage portion (not illustrated) which stores an ink and is configured to be capable of refilling the ink storage portion (not illustrated) with the ink in a state in which the cover 74 is open with respect to the apparatus main body 64.

A window portion 76 (FIGS. 19 to 22) is provided in a front surface 64*a* of the apparatus main body 64. In this embodiment, the window portion 76 is provided at a position corresponding to the home position of the carriage 70 in the front surface 64*a* of the apparatus main body 64. The window portion 76 is configured to enable the visual recognition of the inside of the apparatus main body 64 from the front side of the apparatus main body 64. In this embodiment, a configuration is adopted in which when the carriage 70 is positioned at the home position, it is possible to visually recognize the remaining amount of the ink in the ink storage portion (not illustrated) inside the carriage 70 via the window portion 76.

The feed tray 66 is provided on the front surface 64*a* of the apparatus main body 64. In this embodiment, the feed tray 66 is configured to be capable of switching between the storage state (FIG. 18) and the extended state (FIGS. 19 to 24) with respect to the apparatus main body 64. For example, the feed tray 66 is configured to be capable of rotational movement relative to the apparatus main body 64 using the −Z-direction side end portion as the rotational movement fulcrum. The feed tray 66 is provided with an exterior surface 66*a* and a placement surface 66*b* which is a surface of the opposite side from the exterior surface 66*a*.

As illustrated in FIG. 18, in the feed tray 66, in the non-extended state in which the placement surface 66*b* is stored inside the apparatus main body 64, the exterior surface 66*a* assumes a state of forming the same surface as the front surface 64*a* of the apparatus main body 64. Accordingly, it is possible to reduce unevenness on the front surface 64*a* of the printer 62 and it is possible to improve the aesthetic of the front surface of the printer 62.

As illustrated in FIG. 19, when the feed tray 66 is rotationally moved from the storage state to the +Y-direction side, the placement surface 66*b* is extended to the outside of the apparatus main body 64 and assumes the extended state (FIGS. 19 and 20) in which it is possible to place the medium P on the placement surface 66*b*. In this embodiment, the dimension of the printer 62 in the Y-axis direction (the apparatus depth direction) in the storage state of the feed tray 66 is set to be smaller than the length in the longitudinal direction of the medium P of the maximum size which may be set in the feed tray 66, for example, is set to be smaller than the length in the longitudinal direction of the A4 size. It is possible to set the medium P of the maximum size, for example, A4 size in the feed tray 66 by setting the feed tray 66 to the extended state on the +Y-axis direction side (FIG. 20). Therefore, it is possible to obtain a reduction in the size of the printer 62 in the Y-axis direction.

When the feed tray 66 is set to the extended state, the medium receiving tray 68 and a discharge port 78 are exposed on the front side of the printer 62. In this embodiment, in the storage state of the feed tray 66, the progression path to the +Y-direction side of the apparatus main body 64 of the medium receiving tray 68 and the discharge port 78 assume a blocked state, and in the extended state of the feed tray 66, the progression path to the +Y-direction side of the apparatus main body 64 of the medium receiving tray 68 and the discharge port 78 assume an open state.

In this embodiment, the medium receiving tray 68 is provided with a base tray 80 and at least one sub-tray, in this embodiment, two sub-trays 82 and 84. As illustrated in FIG. 22, for example, the sub-tray 82 is configured to be capable of being pulled out with respect to the base tray 80 and is capable of receiving the medium P by being pulled out from the base tray 80. The sub-tray 84 is configured to be capable of rotational movement with respect to the sub-tray 82 at the +Y-direction side end portion of the sub-tray 82 and assumes a medium receiving posture by being rotationally moved to the +Y-direction side with respect to the sub-tray 82. The base tray 80 and the sub-trays 82 and 84 are provided with medium receiving surfaces 80*a*, 82*a*, and 84*a*, respectively.

In this embodiment, the medium receiving tray 68 is configured to be capable of switching between a first state (FIGS. 19 and 20) in which the medium receiving tray 68 is stored in the apparatus main body 64 in the extended state of the feed tray 66 and the medium receiving surface 80*a* is in the non-extended state on the outside of the apparatus and a second state (FIGS. 21 to 24) in which the medium receiving tray 68 is pulled out to the +Y-direction side from the apparatus main body 64 and the medium receiving surface 80*a* is extended to the outside of the apparatus.

The second state includes not only a state (FIG. 21) in which only the medium receiving surface 80*a* is extended to the outside of the apparatus, but also a state in which the sub-tray 82 is pulled out from the base tray 80 and the medium receiving surface 82*a* is extended to the +Y-direction side, or alternatively, a state in which the sub-tray 82 is pulled out from the base tray 80, the sub-tray 84 is further rotationally moved with respect to the sub-tray 82, and the medium receiving surfaces 82*a* and 84*a* are extended.

As illustrated in FIGS. 21, 23, and 24, in a state in which the base tray 80 is pulled out from the apparatus main body 64, the base tray 80 is configured to be positioned above the medium P which is placed in the feed tray 66 and to cover the medium P. In FIG. 23, the dimensions of the base tray 80, which protrudes in the +Y-axis direction from the apparatus main body 64 in the second state, in the X-axis direction and the Y-axis direction are set to a size at which the base tray 80 covers the medium P of the maximum size to be set in the feed tray 66. In other words, in the second state, the base tray 80 functions not only as the medium receiving tray but also functions as the cover which reduces the adherence of dust or the like to the medium which is set in the feed tray 66.

As illustrated in FIG. 24, when the base tray 80 is in the second state, since the medium P which is placed in the feed tray 66 is in a state of being covered by the base tray 80, the medium P may not be visually recognized from the +Z-direction side. However, the dimensions of the base tray 80 in the X-axis direction and the Y-axis direction are set such that it is possible to visually recognize the medium P which is placed in the feed tray 66 from the X-axis direction side. Accordingly, even in a state in which the medium P which is placed on the feed tray 66 is covered by the base tray 80, it is possible to confirm that the medium P is set on the feed tray 66.

The printer 62 includes the recording head 72 which performs recording on the medium P, the feed tray 66 which is provided in the apparatus main body 64 which includes the recording head 72, includes the placement surface 66*b* on which the medium P which is fed is placed, and is capable of switching between a storage state which is a non-extended state of the placement surface 66*b* and an extended state in which the placement surface 66*b* is extended to an outside of the apparatus main body 64 and in which it is possible to place the medium P on the placement surface 66*b*, and the medium receiving tray 68 which includes the medium receiving surfaces 80*a*, 82*a*, and 84*a* which receive the medium P which is subjected to recording by the recording head 72 and is discharged, and is capable of switching between a first state which is a non-extended state of the medium receiving surfaces 80*a*, 82*a*, and 84*a* and a second state in which the medium receiving surface 80*a* is extended to the outside of the apparatus main body 64, in which the medium receiving tray 68 assumes a state of covering the medium which is placed on the feed tray 66 between the first state and the second state. In this configuration, it is not necessary to provide a dedicated cover which covers the feed tray 66 and it is possible to suppress an increase in the cost of the apparatus.

In a state in which the medium receiving tray 68 covers the medium P which is placed on the feed tray 66, the medium P which is placed on the feed tray 66 is visually recognizable from a side in the X-axis direction which is a direction intersecting the Y-axis direction. In this configuration, it is possible to easily recognize the remaining number of sheets of the medium P which is placed in the feed tray 66.

The medium receiving tray 68 includes the base tray 80 which is positioned closest to the apparatus main body 64 side in the second state and at least one of the sub-trays 82 and 84 which are positioned on a side which is further from the apparatus main body 64 than the base tray 80, the base tray 80 and the sub-trays 82 and 84 are stored in an inner portion of the apparatus main body 64 in the first state, and by pulling out the base tray 80 from the apparatus main body 64, the base tray 80 covers the medium P which is placed on the feed tray 66. In this configuration, it is possible to reliably cover the medium P which is placed on the feed tray 66.

The feed tray 66 is configured to switch between the storage state and the extended state by rotationally moving, the feed tray 66 blocks a progression path from the apparatus main body 64 and the discharge port 78 of the medium P of the base tray 80 and the sub-trays 82 and 84 when the feed tray 66 is in the storage state, and by switching the feed tray 66 from the storage state to the extended state, the feed tray 66 opens the progression path. In this configuration, it is possible to suppress the entrance of dust or the like into the inner portion of the apparatus.

In the feed tray 66, the exterior surface 66*a* which is a surface of an opposite side from the placement surface 66*b* is the same surface as the apparatus front surface 64*a* when the feed tray 66 is in the storage state. In this configuration, since the exterior surface 66*a* of the feed tray 66 is the same surface as the apparatus front surface 64*a* when the feed tray 66 is in the storage state, it is possible to reduce the unevenness of the apparatus front surface of the printer 10 and it is possible to improve the aesthetic of the apparatus front surface.

Modification Example

In this embodiment, a configuration is adopted in which the sub-tray 84 is rotationally moved with respect to the sub-tray 82. However, instead of this configuration, a configuration may be adopted in which the sub-tray 84 is a drawer type of tray similar to the sub-tray 82.

In the above-described embodiments, although the medium storage cassettes 20, 32, 36, 48, and 56, the feed tray 66, and the medium receiving tray 68 are applied to an ink jet printer as an example of the recording apparatus, it is possible to apply these to other liquid ejecting apparatuses in general.

Here, the liquid ejecting apparatus is not limited to a recording apparatus such as a printer, a copier, a facsimile, or the like in which an ink jet recording head is used and an ink is discharged from the recording head to perform recording on a recording medium, and includes a device which ejects, instead of the ink, a liquid corresponding to the usage thereof from a liquid ejecting head corresponding to the ink jet recording head onto an ejection target medium corresponding to the recording medium to cause the liquid to adhere to the ejection target medium.

Other than the recording head, examples of the liquid ejecting heads include color material ejecting heads used in the manufacture of color filters of liquid crystal displays and the like, electrode material (conductive paste) ejecting heads used to form electrodes of EL displays, field emission displays (FED), and the like, biological organic matter ejecting heads used in the manufacture of biochips, and sample ejecting heads which serve as precision pipettes.

The invention is not limited to the embodiments and may be modified in various ways within the scope of the invention described in the claims, and the modifications should be construed as being included in the invention.

The entire disclosure of Japanese Patent Application No. 2017-146668, filed Jul. 28, 2017 and No. 2018-006552, filed Jan. 18, 2018 are expressly incorporated by reference herein.

What is claimed is:

1. A recording apparatus comprising:

a recording unit which performs recording on a medium;

a feed tray which is provided in an apparatus main body which includes the recording unit, includes a placement surface on which the medium which is fed is placed, and is capable of switching between a storage state which is a non-extended state of the placement surface and an extended state in which the placement surface is extended to an outside of the apparatus main body and in which it is possible to place the medium on the placement surface; and a medium receiving tray which includes a medium receiving surface which receives the medium which is subjected to recording by the recording unit and is discharged, and is capable of switching between a first state which is a non-extended state of the medium receiving surface and a second state in which the medium receiving surface is extended to the outside of the apparatus main body, wherein the medium receiving tray assumes a state of covering the medium which is placed on the feed tray between the first state and the second state, wherein the medium receiving tray includes:

a base tray which is positioned closest to the apparatus main body side in the second state, and at least one sub-tray which is positioned on a side which is further from the apparatus main body than the base tray, wherein the base tray and the sub-tray are stored in an inner portion of the apparatus main body in the first state, and wherein by pulling out the base tray from the apparatus main body, the base tray covers the medium which is placed on the feed tray.

2. The recording apparatus according to claim 1, wherein the medium which is placed on the feed tray is visually recognizable from a side in a medium width direction which is a direction intersecting a medium feed direction in a state in which the medium receiving tray covers the medium which is placed on the feed tray.

3. The recording apparatus according to claim 1, wherein the feed tray is configured to switch between the storage state and the extended state by rotationally moving, wherein the feed tray blocks a progression path from the apparatus main body and a discharge port of the medium of the base tray and the sub-tray when the feed tray is in the storage state, and wherein by switching the feed tray from the storage state to the extended state, the feed tray opens the progression path.

4. The recording apparatus according to claim 3, wherein in the feed tray, a surface of an opposite side from the placement surface is the same surface as an apparatus front surface when the feed tray is in the storage state.

5. A recording apparatus comprising:

a recording unit which performs recording on a medium;

a feed tray which is provided in an apparatus main body which includes the recording unit, includes a placement surface on which the medium which is fed is placed, and is capable of switching between a storage state which is a non-extended state of the placement surface and an extended state in which the placement surface is extended to an outside of the apparatus main body and in which it is possible to place the medium on the placement surface; and a medium receiving tray which includes a medium receiving surface which receives the medium which is subjected to recording by the recording unit and is discharged, and is capable of switching between a first state which is a non-extended state of the medium receiving surface and a second state in which the medium receiving surface is extended to the outside of the apparatus main body, wherein the medium receiving tray assumes a state of covering the medium which is placed on the feed tray between the first state and the second state, and wherein the feed tray is configured to switch between the storage state and the extended state by rotationally moving.

* * * * *